US011560527B2

(12) United States Patent
Masuda et al.

(10) Patent No.: US 11,560,527 B2
(45) Date of Patent: Jan. 24, 2023

(54) LUBRICATING OIL COMPOSITION FOR TRANSMISSION

(71) Applicant: ENEOS Corporation, Tokyo (JP)

(72) Inventors: Kohei Masuda, Tokyo (JP); Haruko Nagai, Tokyo (JP); Masaaki Itou, Tokyo (JP); Mayuko Sumiya, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 17/430,152

(22) PCT Filed: Feb. 20, 2020

(86) PCT No.: PCT/JP2020/006928
§ 371 (c)(1),
(2) Date: Aug. 11, 2021

(87) PCT Pub. No.: WO2020/171188
PCT Pub. Date: Aug. 27, 2020

(65) Prior Publication Data

US 2022/0127543 A1 Apr. 28, 2022

(30) Foreign Application Priority Data

Feb. 20, 2019 (JP) ..... JP2019-028665

(51) Int. Cl.

| | |
|---|---|
| ***C10M 169/04*** | (2006.01) |
| ***C10M 145/14*** | (2006.01) |
| ***C10M 133/30*** | (2006.01) |
| ***C10M 133/44*** | (2006.01) |
| ***C10M 135/10*** | (2006.01) |
| ***C10M 137/10*** | (2006.01) |
| ***C10M 141/10*** | (2006.01) |
| ***C10M 161/00*** | (2006.01) |
| *C10N 20/02* | (2006.01) |
| *C10N 20/04* | (2006.01) |
| *C10N 30/02* | (2006.01) |
| *C10N 30/04* | (2006.01) |
| *C10N 40/04* | (2006.01) |

(52) U.S. Cl.
CPC ..... *C10M 169/044* (2013.01); *C10M 133/30* (2013.01); *C10M 133/44* (2013.01); *C10M 135/10* (2013.01); *C10M 137/105* (2013.01); *C10M 141/10* (2013.01); *C10M 145/14* (2013.01); *C10M 161/00* (2013.01); *C10M 2203/003* (2013.01); *C10M 2209/084* (2013.01); *C10M 2215/26* (2013.01); *C10M 2215/30* (2013.01); *C10M 2219/044* (2013.01); *C10M 2223/047* (2013.01); *C10M 2223/049* (2013.01); *C10N 2020/02* (2013.01); *C10N 2020/04* (2013.01); *C10N 2030/02* (2013.01); *C10N 2030/04* (2013.01); *C10N 2040/04* (2013.01)

(58) Field of Classification Search
CPC ..... C10M 145/14; C10M 2209/084; C10N 2020/02; C10N 2020/04; C10N 2040/04; C10N 2040/042
See application file for complete search history.

(56) References Cited

U.S. PATENT DOCUMENTS

| | | | | |
|---|---|---|---|---|
| 2007/0191239 | A1* | 8/2007 | Matsuoka | C10M 171/02 508/465 |
| 2011/0034358 | A1 | 2/2011 | Komatsubara | |
| 2011/0294708 | A1 | 12/2011 | Narita | |
| 2012/0065109 | A1 | 3/2012 | Matsuoka et al. | |
| 2012/0220505 | A1* | 8/2012 | Abraham | C10M 167/00 508/174 |
| 2012/0316092 | A1* | 12/2012 | Fujita | C10M 111/04 508/391 |
| 2012/0329692 | A1* | 12/2012 | Noles, Jr. | C10M 141/10 508/408 |
| 2014/0011724 | A1* | 1/2014 | Onumata | C10M 169/04 508/469 |
| 2015/0057202 | A1* | 2/2015 | Nakao | C10M 101/02 208/18 |
| 2016/0040095 | A1* | 2/2016 | Fujii | C10M 169/044 508/463 |
| 2016/0108337 | A1 | 4/2016 | Abraham et al. | |
| 2018/0066204 | A1* | 3/2018 | Sampler | C10M 139/00 |
| 2018/0119049 | A1 | 5/2018 | Yokomizo et al. | |
| 2019/0085258 | A1* | 3/2019 | Hamachi | C10M 169/041 |
| 2019/0112541 | A1* | 4/2019 | Hamachi | C10M 107/02 |
| 2019/0367830 | A1* | 12/2019 | Iwai | C10M 171/02 |
| 2020/0032160 | A1* | 1/2020 | Komatsubara | C10M 145/14 |
| 2020/0263105 | A1* | 8/2020 | Kamei | C10M 107/02 |
| 2020/0332216 | A1* | 10/2020 | Hamachi | C10M 169/041 |
| 2021/0147760 | A1* | 5/2021 | Vincent | C10M 161/00 |

FOREIGN PATENT DOCUMENTS

| | | | |
|---|---|---|---|
| CN | 104160002 | A | 11/2014 |
| CN | 107987931 | A | 5/2018 |
| EP | 2 135 929 | A1 | 12/2009 |
| JP | 2011-052047 | | 3/2011 |
| JP | 2016-216683 | | 12/2016 |
| JP | 2018-507947 | | 3/2018 |
| WO | 2009/125551 | | 10/2009 |
| WO | 2010/087398 | | 8/2010 |

(Continued)

OTHER PUBLICATIONS

ISR issued in International Patent Application No. PCT/JP2020/006928, May 19, 2020, English translation.

(Continued)

*Primary Examiner* — Ellen M McAvoy
(74) *Attorney, Agent, or Firm* — Greenblum & Bernstein P.L.C.

(57) ABSTRACT

A lubricating oil composition for a transmission, the composition including: (A) a lubricant base oil comprising a mineral base oil and/or a synthetic base oil; and (B) a poly(meth)acrylate having a weight average molecular weight of no more than 25,000, wherein the composition has a kinematic viscosity at 100° C. of 2.5 to 4.9 $mm^2/s$.

17 Claims, No Drawings

(56) References Cited

FOREIGN PATENT DOCUMENTS

| | | |
|---|---|---|
| WO | 2013/136582 | 9/2013 |
| WO | 2016/158999 | 10/2016 |

OTHER PUBLICATIONS

IPRP issued in International Patent Application No. PCT/JP2020/006928, Aug. 10, 2021, English translation.

* cited by examiner

LUBRICATING OIL COMPOSITION FOR TRANSMISSION

TECHNICAL FIELD

The present invention relates to a lubricating oil composition for a transmission (transmission oil composition), and more specifically, relates to a lubricating oil composition for a transmission which is suitable for a transmission equipped with a wet clutch such as a multiplate wet clutch.

BACKGROUND ART

One means for improving energy efficiency of gears such as transmissions and final drive gears is to use a less viscous lubricating oil. For example, transmissions and final drives etc. are equipped with a gear bearing mechanism. It is considered that a less viscous lubricating oil used for the foregoing reduces churning resistance and drag torque which are caused by the viscosity resistance of a lubricating oil, and improves power transmission efficiency, which can result in improvement in fuel efficiency.

CITATION LIST

Patent Literature

Patent Literature 1: JP 2011-052047 A
Patent Literature 2: WO 2010/087398
Patent Literature 3: WO 2016/158999
Patent Literature 4: WO 2009/125551

SUMMARY OF INVENTION

Technical Problem

A less viscous lubricating oil used for such gears makes it difficult to maintain an oil film thickness on a lubricated surface, which leads to a tendency to shorten the fatigue life of a bearing.

In addition, improved shift shock prevention properties are demanded of a lubricating oil used for transmissions equipped with a wet clutch such as a multiplate wet clutch.

An object of the present invention is to provide a lubricating oil composition for a transmission which achieves improved fuel efficiency, and which also satisfies the fatigue life of a bearing and shift shock prevention properties which are demanded of a transmission oil.

Solution to Problem

The present invention encompasses the following embodiments [1] to [16].

[1] A lubricating oil composition for a transmission, the composition comprising:

(A) a lubricant base oil comprising a mineral base oil and/or a synthetic base oil; and (B) a poly(meth)acrylate having a weight average molecular weight of no more than 25,000, wherein the composition has a kinematic viscosity at 100° C. of 2.5 to 4.9 $mm^2/s$.

In the present description, "(meth)acrylate" means "acrylate and/or methacrylate".

[2] The lubricating oil composition according to [1], wherein the component (A) has a kinematic viscosity at 100° C. of 2.0 to 3.8 $mm^2/s$.

[3] The lubricating oil composition according to [1] or [2], wherein the component (A) has a % $C_A$ of no more than 1.0.

[4] The lubricating oil composition according to any one of [1] to [3], wherein the component (B) is a non-dispersant poly (meth)acrylate.

[5] The lubricating oil composition according to any one of [1] to [4], wherein a content of the component (B) is 0.01 to 5 mass % on the basis of the total mass of the composition.

[6] The lubricating oil composition according to any one of [1] to [5], wherein the component (B) is a poly(meth)acrylate comprising a branched chain alkyl group in a side chain.

[7] The lubricating oil composition according to any one of [1] to [6], further comprising:

(C) a calcium sulfonate detergent.

[8] The lubricating oil composition according to [7], wherein the component (C) is a calcium sulfonate detergent comprising an alkyl group derived from an oligomer of an olefin, the olefin having at least 3 carbons.

[9] The lubricating oil composition according to any one of [1] to [8], wherein the component (B) is (B2) at least one polyalkyl (meth)acrylate each having a weight average molecular weight of no more than 20,000;

a content of the component (B2) is no less than 0.2 mass % on the basis of the total mass of the composition;

each of the polyalkyl (meth)acrylate (B2) comprises (B2a) at least one alkyl (meth)acrylate monomer unit having a C8-18 linear chain or branched chain alkyl group, in an amount of no less than 70 mol % on the basis of the total monomer units; and each of the polyalkyl (meth)acrylate (B2) optionally further comprises (B2c) a methyl (meth)acrylate monomer unit in an amount of less than 3 mol % on the basis of the total monomer units.

[10] The lubricating oil composition according to [9], wherein each of the polyalkyl (meth)acrylate (B2) optionally further comprises (B2d) at least one alkyl (meth) acrylate monomer unit having a C1-3 linear chain or branched chain alkyl group, in an amount of less than 3 mol % on the basis of the total monomer units.

[11] The lubricating oil composition according to [9] or [10], wherein each of the polyalkyl (meth)acrylate (B2) optionally further comprises (B2e) at least one alkyl (meth)acrylate monomer unit having a C4-7 linear chain or branched chain alkyl group, in an amount of no more than 20 mol % on the basis of the total monomer units.

[12] The lubricating oil composition according to any one of [9] to [11], wherein each of the polyalkyl (meth)acrylate (B2) optionally further comprises (B2f) at least one alkyl (meth)acrylate monomer unit having a linear chain or branched chain alkyl group, the alkyl group having at least 37 carbons, in an amount of less than 3 mol % on the basis of the total monomer units.

[13] The lubricating oil composition according to any one of [9] to [12], wherein each of the polyalkyl (meth)acrylate (B2) optionally further comprises (B2g) at least one alkyl (meth) acrylate monomer unit having a C19-36 linear chain or branched chain alkyl group, in an amount of no more than 10 mol % on the basis of the total monomer units.

[14] The lubricating oil composition according to any one of [9] to [13], wherein each of the polyalkyl (meth)acrylate (B2) optionally further comprises (B2h) at least one monomer unit corresponding to at least one comonomer selected from a C2-18 α-olefin and an α,β-unsaturated dicarboxylic acid diester, in an amount of less than 10 mol % on the basis of the total monomer units.

[15] The lubricating oil composition according to any one of [1] to [14], further comprising:

(D) a phosphorus-containing additive in an amount of 50 to 800 mass ppm in terms of phosphorus on the basis of the total mass of the composition; and (E) a succinimide ashless dispersant in an amount of 0.2 to 8 mass % on the basis of the total mass of the composition.

[16] The lubricating oil composition according to any one of [1] to [15], optionally further comprising:

(F) an amine friction modifier in an amount of no more than 50 mass ppm on the basis of the total mass of the composition.

Advantageous Effects of Invention

The present invention can provide a lubricating oil composition for a transmission which achieves improved fuel efficiency, and which also satisfies the fatigue life of a bearing and shift shock prevention properties which are demanded of a transmission oil.

DESCRIPTION OF EMBODIMENTS

The present invention will be described hereinafter. It is noted that expression "A to B" concerning numeral values A and B means "no less than A and no more than B" unless otherwise specified. In such expression, if a unit is added only to the numeral value B, the same unit is applied to the numeral value A. A word "or" means a logical sum unless otherwise specified. In the present description, expression "$E_1$ and/or $E_2$" concerning elements $E_1$ and $E_2$ is equivalent to "$E_1$, or $E_2$, or the combination thereof", and expression "$E_1$, . . . , $E_{N-1}$, and/or $E_N$" concerning n elements $E_1$, . . . , $E_N$ (N is an integer of 3 or more) is equivalent to "$E_1$, . . . , or $E_N$, or any combination thereof".

In the present description, unless otherwise specified, the content of each element of calcium, magnesium, zinc, phosphorus, sulfur, boron, barium and molybdenum in an oil shall be measured by inductively coupled plasma atomic emission spectrometry (intensity ratio method) conforming to JPI-5S-38-2003, and the content of a nitrogen element in an oil shall be measured by the chemiluminescence method conforming to JIS K2609. In the present description, "weight average molecular weight" means a weight average molecular weight measured by gel permeation chromatography (GPC) in terms of standard polystyrene. The measurement conditions for GPC are as follows.

[GPC Measurement Conditions]

device: ACQUITY™ APC UV RI System manufactured by Waters Corporation column: in order from the upstream side: one column of ACQUITY™ APC XT125A manufactured by Waters Corporation (gel particle size: 2.5 μm, column size (inner diameter×length): 4.6 mm×150 mm); and two columns of ACQUITY™ APC XT45A manufactured by Waters Corporation (gel particle size: 1.7 μm, column size (inner diameter×length): 4.6 mm×150 mm), connected in series column temperature: 40° C.

sample solution: tetrahydrofuran solution whose sample concentration is 1.0 mass % solution injection volume: 20.0 μL detector: differential refractometer standard material: standard polystyrene (Agilent EasiCal™ PS-1 manufactured by Agilent Technologies, Inc.) (10 points of molecular weight: 30230, 9590, 2970, 890, 786, 682, 578, 474, 370 and 266)

(A) Lubricating Base Oil

A base oil consisting of at least one selected from a mineral base oil and a synthetic base oil may be used as a lubricating base oil in a lubricating oil composition for a transmission according to the present invention (hereinafter may be referred to as "transmission oil" or "lubricating oil composition") without particular limitation.

Specific examples of the mineral base oil include: paraffinic or naphthenic mineral base oils obtained by refining lubricant oil fractions through at least one of refining processes such as solvent deasphalting, solvent extraction, hydrocracking, hydroisomerizing, solvent dewaxing, catalytic dewaxing, and hydrorefining, the lubricant oil fractions being obtained by vacuum distillation of atmospheric residue obtained by atmospheric distillation of crude oil; a wax isomerized mineral oil; and a base oil produced by a process including isomerizing GTL WAX (gas to liquid wax).

A hydrocracked mineral base oil, and/or a wax isomerized isoparaffinic base oil that is obtained by isomerizing a raw material containing a petroleum wax or GTL wax (such as Fischer-Tropsch synthetic oil) in an amount of no less than 50 mass % may be preferably used as the mineral base oil.

Examples of the synthetic base oil include poly-α-olefins (such as ethylene-propylene copolymer, polybutene, 1-octene oligomer, and 1-decene oligomer) or hydrogenated products thereof; monoesters (such as butyl stearate, octyl laurate, and 2-ethylhexyl oleate); diesters (such as ditridecyl glutarate, bis(2-ethylhexyl) adipate, diisodecyl adipate, ditridecyl adipate, and bis(2-ethylhexyl) sebacate); polyesters (such as trimellitate esters); polyol esters (such as trimethylolpropane caprylate, trimethylolpropane pelargonate, pentaerythritol 2-ethylhexanoate, and pentaerythritol pelargonate); aromatic synthetic oils (such as alkylbenzene, alkylnaphthalene, and aromatic esters); and mixtures thereof.

The % $C_P$ of the mineral base oil in view of improvement in viscosity-temperature characteristics, thermal and oxidation stability, and friction properties is preferably no less than 70, and more preferably no less than 80; and in view of improvement in solubility of additives, is usually no more than 99, and preferably no more than 95.

The % $C_A$ of the mineral base oil in view of improvement in viscosity-temperature characteristics, and thermal and oxidation stability, and further improvement in the fatigue life of a bearing and fuel efficiency is preferably no more than 1.0, more preferably no more than 0.8, and especially preferably no more than 0.5, and may be 0.

The % $C_N$ of the mineral base oil in view of improvement in viscosity-temperature characteristics, thermal and oxidation stability, and friction properties is preferably no more than 35, and more preferably no more than 30; and in view of improvement in solubility of additives, is preferably no less than 1, and more preferably no less than 4.

In the present description, a % $C_P$, a % $C_N$ and a % $C_A$ mean a percentage of the paraffinic carbon number to all the carbon atoms, a percentage of the naphthenic carbon number to all the carbon atoms, and a percentage of the aromatic carbon number to all the carbon atoms, respectively, which are obtained by the method conforming to ASTM D 3238-85 (n-d-M ring analysis). That is, the above described preferred ranges of the % $C_P$, % $C_N$ and % $C_A$ are based on values obtained according to the above method. For example, the % $C_N$ obtained according to the above method can indicate more than 0 even if the mineral base oil does not contain any naphthenes.

The kinematic viscosity of the lubricating base oil (total base oil) at 100° C. in view of good low-temperature viscosity properties of the lubricating oil composition, and further improvement in fuel efficiency is preferably no more than 3.8 $mm^2/s$; and in view of enough oil film formation at a lubricating point to improve lubricity, is preferably no less than 2.0 $mm^2/s$. In this description, "kinematic viscosity at 100° C." means kinematic viscosity at 100° C. specified in JIS K 2283-1993.

The kinematic viscosity of the lubricating base oil (total base oil) at 40° C. in view of good low-temperature viscosity properties of the lubricating oil composition, and further improvement in fuel efficiency is preferably no more than 40 $mm^2/s$, more preferably no more than 30 $mm^2/s$, further preferably no more than 20 $mm^2/s$, and especially preferably no more than 15 $mm^2/s$; and in view of enough oil film formation at a lubricating point to improve lubricity, is preferably no less than 7.0 $mm^2/s$, more preferably no less than 7.5 $mm^2/s$, and especially preferably no less than 8.0 $mm^2/s$. In this description, "kinematic viscosity at 40° C." means kinematic viscosity at 40° C. specified in JIS K 2283-1993.

The viscosity index of the lubricating base oil (total base oil) in view of improvement in viscosity-temperature characteristics, thermal and oxidation stability, and anti-wear properties of the lubricating oil composition is preferably no less than 90, more preferably no less than 100, and further preferably no less than 110; and in view of further improvement in the fatigue life of a bearing, is especially preferably no less than 120. The viscosity index in the present description means a viscosity index measured conforming to JIS K 2283-1993.

The pour point of the lubricating base oil (total base oil) in view of improvement in low-temperature fluidity of the entire lubricating oil composition is preferably no more than −10° C., more preferably no more than −12.5° C., further preferably no more than −15° C., especially preferably no more than −17.5° C., and most preferably no more than −20.0° C. The pour point in the present description means a pour point measured conforming to JIS K 2269-1987.

The sulfur content in the lubricating base oil (total base oil) in view of improvement in oxidation stability, and further improvement in the fatigue life of a bearing is preferably no more than 0.03 mass %, and more preferably no more than 50 mass ppm, and may be no more than 10 mass ppm. Here, "sulfur content in the lubricating base oil (total base oil)" shall be measured conforming to JIS K 2541-2003.

In one embodiment, in view of further improvement in the fatigue life of a bearing, the lubricating base oil (total base oil) preferably comprises (A1) a Group II base oil of API base stock categories (hereinafter may be referred to as "API Group II base oil" or simply "Group II base oil"), a Group III base oil of API base stock categories (hereinafter may be referred to as "API Group III base oil" or simply "Group III base oil"), or a Group IV base oil of API base stock categories (hereinafter may be referred to as "API Group IV base oil" or simply "Group IV base oil"), or a mixture thereof, in an amount of no less than 70 mass % on the basis of the total mass of the lubricating base oil (total base oil). In view of further improvement of the fatigue life of a bearing, the content of the base oil (A1) in the lubricating base oil (total base oil) is more preferably no less than 80 mass %, and may be no less than 90 mass % in one embodiment. The group II base oil is a mineral base oil having a sulfur content of no more than 0.03 mass %, saturates of no less than 90 mass %, and a viscosity index of no less than 80 and less than 120. The group III base oil is a mineral base oil having a sulfur content of no more than 0.03 mass %, saturates of no less than 90 mass %, and a viscosity index of no less than 120. The group IV base oil is a poly-α-olefin base oil.

In the embodiment such that the lubricating base oil (total base oil) comprises the base oil (A1), in view of further improvement in the fatigue life of a bearing, the content of the Group II base oil, or the Group III base oil, or a mixture thereof is preferably 40 to 100 mass %, and may be 50 to 100 mass % in one embodiment, on the basis of the total mass of the lubricating base oil (total base oil).

In the embodiment such that the lubricating base oil (total base oil) comprises the base oil (A1), in view of further improvement in the fatigue life of a bearing, and further reduction of wear of a vane pump, the content of the Group III base oil is preferably 40 to 100 mass %, and more preferably 50 to 100 mass %, and may be 80 to 100 mass % in one embodiment, on the basis of the total mass of the lubricating base oil (total base oil). A vane pump may be used as a circulation pump for a lubricating oil. Generally, the sliding velocity between metals is high in the lubrication conditions for a vane pump. Thus, lubrication characteristics different from those demanded of a lubricating oil in a lubrication system using a gear pump may be demanded in a lubrication system using a vane pump.

In the embodiment such that the lubricating base oil (total base oil) comprises the base oil (A1), the lubricating base oil (total base oil) may further comprise a Group I base oil of API base stock categories (hereinafter may be referred to as "API Group I base oil" or simply "Group I base oil"). The API group I base oil is a mineral base oil having a viscosity index of no less than 80 and less than 120, and a sulfur content of more than 0.03 mass % and/or saturates of less than 90 mass %. In view of further improvement in the fatigue life of a bearing, and further reduction of wear of a vane pump, the content of the API Group I base oil in the lubricating base oil (total base oil) is preferably less than 10 mass %, may be no more than 8 mass % in one embodiment, and may be less than 5 mass % in another embodiment, on the basis of the total mass of the lubricating base oil (total base oil).

In the embodiment such that the lubricating base oil (total base oil) comprises the base oil (A1), the lubricating base oil (total base oil) may further comprise a Group V base oil of API base stock categories (hereinafter may be referred to as "API Group V base oil" or simply "Group V base oil"). The API Group V base oil is a base oil other than the Group I to IV base oils of API base stock categories, and is preferably an ester base oil. Preferred examples of the API Group V base oil include monoester base oils, diester base oils and polyester base oils which are described above as the examples of the synthetic base oils. At least one ester base oil selected from them may be preferably used. The content of the API Group V base oil in the lubricating base oil (total base oil) in view of further improvement in the fatigue life of a bearing is 0.1 to 20 mass % in one embodiment, and may be 0.1 to 10 mass % in another embodiment.

In one embodiment, in view of further improvement in the fatigue life of a bearing, and further reduction of wear of a vane pump, the lubricating base oil (total base oil) preferably consists of: the API Group II base oil, or the API Group III base oil, or a combination thereof, in an amount of 50 to 100 mass % on the basis of the total mass of the base oil; optionally the API Group IV base oil in an amount of 0 to 50 mass % on the basis of the total mass of the base oil; optionally the API Group I base oil in an amount of less than 10 mass % on the basis of the total mass of the base oil; and optionally the API Group V base oil in an amount of no more than 10 mass % on the basis of the total mass of the base oil.

In one embodiment, the content of the lubricating base oil (total base oil) in the lubricating oil composition is preferably 70 to 98 mass %, and more preferably 80 to 98 mass %, on the basis of the total mass of the lubricating oil composition.

In one embodiment, the content of the base oil (A1) in the lubricating oil composition is preferably 28 to 98 mass %, and more preferably 40 to 98 mass %, on the basis of the total mass of the lubricating oil composition.

(B) Poly(meth)acrylate

The lubricating oil composition according to the present invention comprises a poly(meth)acrylate having a weight average molecular weight of no more than 25,000 (hereinafter may be referred to as "component (B)"). In the present description, "(meth)acrylate" means "acrylate and/or methacrylate". Using the poly(meth)acrylate as the component (B) can improve shift shock prevention properties and the fatigue life of a bearing more than a composition using any other polymer having the same weight average molecular weight.

As the component (B), a dispersant or non-dispersant poly(meth)acrylate may be used. In view of improvement in the fatigue life of a bearing, and further reduction of wear of a vane pump, a non-dispersant poly(meth)acrylate may be preferably used. A poly(meth)acrylate comprising a linear chain alkyl group in a side chain may be used, and a poly(meth)acrylate comprising a branched chain alkyl group in a side chain may be also used. In view of improvement in the fatigue life of a bearing, a poly(meth)acrylate comprising a branched chain alkyl group in a side chain may be preferably used. In one embodiment, a non-dispersant poly(meth)acrylate comprising a branched chain alkyl group in a side chain may be preferably used. This non-dispersant poly(meth)acrylate comprising a branched chain alkyl group in a side chain may comprise both branched and linear chain alkyl groups in a side chain.

In the present description, "dispersant poly(meth)acrylate" means a poly(meth)acrylate compound having a functional group including a nitrogen atom, and "non-dispersant poly(meth)acrylate" means a poly(meth)acrylate compound having no functional group including a nitrogen atom.

For example, a poly(meth)acrylate compound comprising a (meth)acrylate structural unit represented by the following general formula (1) in an amount of 10 to 100 mol % on the basis of the total monomer units in the polymer (hereinafter may be referred to as "poly(meth)acrylate (B1)") may be preferably employed as a poly(meth)acrylate compound constituting the component (B).

(1)

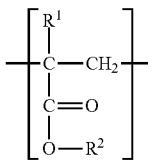

In the formula (1), $R^1$ is hydrogen or a methyl group, and $R^2$ is a C1-24 linear chain or branched hydrocarbon group.

The proportion of the (meth)acrylate structural unit represented by the general formula (1) in the polymer of the poly(meth)acrylate (B1) is preferably 10 to 100 mol %, more preferably 20 to 100 mol %, further preferably 30 to 100 mol %, and most preferably 10 to 100 mol %.

The (meth)acrylate structural unit represented by the general formula (1) is given by polymerization of a monomer represented by the following general formula (2) (hereinafter referred to as "monomer (M-1)"). A polymer obtained by homopolymerization of one monomer (M-1), or copolymerization of a monomer mixture consisting of at least two monomers (M-1) is a non-dispersant poly(meth)acrylate compound.

(2)

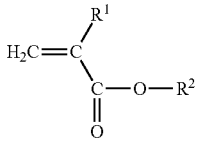

In the formula (2), the definitions of $R^1$ and $R^2$ are the same as in the general formula (1).

The poly(meth)acrylate (B1) may be a copolymer comprising another (meth)acrylate structural unit in addition to the (meth)acrylate structural unit represented by the general formula (1). Such a copolymer may be obtained by copolymerizing one or more monomer(s) (M-1), and a monomer other than the monomer (M-1).

The copolymer may be a copolymer of at least one monomer (M-1), and at least one monomer selected from a monomer represented by the following general formula (3) (hereinafter referred to as "monomer (M-2)") and a monomer represented by the following general formula (4) (hereinafter referred to as "monomer (M-3)"). The copolymer of the monomer (M-1), and the monomer (M-2) and/or (M-3) is a dispersant poly(meth)acrylate compound.

(3)

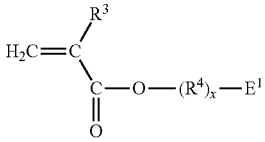

In the formula (3), $R^3$ represents a hydrogen atom or a methyl group, $R^4$ represents a C1-18 alkylene group, $E^1$ represents an amine residue or heterocyclic residue having 1 to 2 nitrogen atom(s) and 0 to 2 oxygen atom(s), and x represents 0 or 1.

Examples of the C1-18 alkylene group represented by $R^4$ include ethylene group, propylene group, butylene group, pentylene group, hexylene group, heptylene group, octylene group, nonylene group, decylene group, undecylene group, dodecylene group, tridecylene group, tetradecylene group, pentadecylene group, hexadecylene group, heptadecylene group, and octadecylene group (each of these alkylene groups may be a linear or branched chain).

Examples of the residue represented by $E^1$ include dimethylamino group, diethylamino group, dipropylamino group, dibutylamino group, anilino group, toluidino group, xylidino group, acetylamino group, benzoylamino group, morpholino group, pyrrolyl group, pyrrolino group, pyridyl group, methylpyridyl group, pyrrolidinyl group, piperidinyl group, piperidino group, quinolyl group, pyrrolidonyl group, pyrrolidono group, imidazolino group, and pyrazinyl group.

(4)

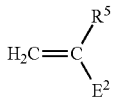

In the formula (4), $R^5$ represents a hydrogen atom or a methyl group, and $E^2$ represents an amine residue or heterocyclic residue having 1 to 2 nitrogen atom(s) and 0 to 2 oxygen atom(s).

Examples of the residue represented by $E^2$ include dimethylamino group, diethylamino group, dipropylamino group, dibutylamino group, anilino group, toluidino group, xylidino group, acetylamino group, benzoylamino group, morpholino group, pyrrolyl group, pyrrolino group, pyridyl group, methylpyridyl group, pyrrolidinyl group, piperidinyl group, piperidino group, quinolyl group, pyrrolidonyl group, pyrrolidono group, imidazolino group, and pyrazinyl group.

Preferred examples of the monomers (M-2) and (M-3) include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures thereof.

The copolymerization molar ratio of the copolymer of the monomer (M-1) and the monomers (M-2) to (M-3) is not specifically restricted. Monomer (M-1):monomers (M-2) to (M-3) is preferably approximately 20:80 to 90:10, more preferably 30:70 to 80:20, and further preferably 40:60 to 70:30.

The production method of the poly(meth)acrylate (B1) is not particularly limited. For example, the poly(meth)acrylate (B1) may be easily obtained by radical solution polymerization of the monomer (M-1) or a monomer mixture comprising the monomer (M-1), in the presence of a polymerization initiator (such as benzoyl peroxide).

The weight average molecular weight of the component (B) in view of improvement in shift shock prevention properties and the fatigue life of a bearing, and further reduction of wear of a vane pump is no more than 25,000, preferably no more than 20,000, and more preferably no more than 15,000; and in view of further improvement in the viscosity index of the lubricating oil composition, is no less than 5,000 in one embodiment; and may be 5,000 to 12,000 in one embodiment.

In one preferred embodiment, as the component (B), (B2) at least one polyalkyl (meth)acrylate each having a weight average molecular weight of no more than 20,000 (hereinafter may be referred to as "polyalkyl (meth)acrylate (B2)" or "polymer (B2)" or simply "component (B2)") may be preferably used. Each of the polymer (B2) comprises (B2a) at least one alkyl (meth)acrylate monomer unit having a C8-18 linear chain or branched chain alkyl group (hereinafter may be simply referred to as "monomer unit (B2a)"), preferably in an amount of no less than 70 mol % on the basis of the total monomer units in the polymer (B2). The monomer unit (B2a) is represented as a (meth)acrylate monomer unit of the formula (1) where $R^1$ is hydrogen or a methyl group, and $R^2$ is a C8-18 linear or branched chain alkyl group. In each of the polymer (B2), the monomer unit (B2a) may consist of one monomer unit, or may be any combination of two or more monomer units. In view of further improvement in the fatigue life of a bearing, and further reduction of wear of a vane pump, the content of the monomer unit (B2a) in each of the polymer (B2) (the total content of the monomer unit (B2a) when the monomer unit (B2a) is a combination of two or more monomer units) is preferably no less than 70 mol %, more preferably no less than 75 mol %, and further preferably no less than 80 mol %, and in one embodiment, may be no less than 85 mol %.

In one preferred embodiment, each of the polymer (B2) comprises (B2b) at least one alkyl (meth)acrylate monomer unit having a C12-15 linear or branched chain alkyl group (hereinafter may be simply referred to as "monomer unit (B2b)") preferably in an amount of no less than 70 mol % on the basis of the total monomer units in each of the polymer (B2). The monomer unit (B2b) is represented as a (meth)acrylate monomer unit of the formula (1) where $R^1$ is hydrogen or a methyl group, and $R^2$ is a C12-15 linear or branched chain alkyl group. That is, the monomer unit (B2a) encompasses the monomer unit (B2b). In each of the polymer (B2), the monomer unit (B2b) may consist of one monomer unit, or may be any combination of two or more monomer units. In view of further improvement in the fatigue life of a bearing, and further reduction of wear of a vane pump, the content of the monomer unit (B2b) in each of the polymer (B2) (the total content of the monomer unit (B2b) when the monomer unit (B2b) is a combination of two or more monomer units) is preferably no less than 70 mol %, more preferably no less than 75 mol %, and further preferably no less than 80 mol %.

Each of the polymer (B2) may optionally further comprise (B2c) a methyl (meth)acrylate monomer unit (hereinafter may be simply referred to as "monomer unit (B2c)"). In view of further improvement in the fatigue life of a bearing, and further reduction of wear of a vane pump, the content of the monomer unit (B2c) in each of the polymer (B2) (the total content of the monomer unit (B2c) when the monomer unit (B2c) is a combination of methyl acrylate and methyl methacrylate) is less than 3 mol %, and preferably less than 1 mol %, and may be 0 mol %, on the basis of the total monomer units in each of the polymer (B2). The monomer unit (B2c) is represented as a (meth)acrylate monomer unit of the formula (1) where $R^1$ is hydrogen or a methyl group, and $R^2$ is a methyl group.

Each of the polymer (B2) may optionally further comprise (B2d) at least one alkyl (meth)acrylate monomer unit having a C1-3 linear chain or branched chain alkyl group (hereinafter may be simply referred to as "monomer unit (B2d)"). In view of further improvement in the fatigue life of a bearing, and further reduction of wear of a vane pump, the content of the monomer unit (B2d) in each of the polymer (B2) (the total content of the monomer units (B2d) when two or more monomer units (B2d) are comprised) is preferably less than 3 mol %, and more preferably less than 1 mol %, and may be 0 mol %, on the basis of the total monomer units in each of the polymer (B2). The monomer unit (B2d) is represented as a (meth)acrylate monomer unit of the formula (1) where $R^1$ is hydrogen or a methyl group, and $R^2$ is a C1-3 linear or branched chain alkyl group. That is, the monomer unit (B2d) encompasses the monomer unit (B2c).

Each of the polymer (B2) may optionally further comprise (B2e) at least one alkyl (meth)acrylate monomer unit having a C4-7 linear chain or branched chain alkyl group (hereinafter may be simply referred to as "monomer unit (B2e)"). In view of further improvement in the fatigue life of a bearing, and further reduction of wear of a vane pump, the content of the monomer unit (B2e) in each of the polymer (B2) (the total content of the monomer units (B2e) when two or more monomer units (B2e) are comprised) is preferably no more than 30 mol %, and more preferably no more than 20 mol %, and in one embodiment, may be no more than 15 mol %, on the basis of the total monomer units in each of the polymer (B2). The monomer unit (B2e) is represented as a (meth)acrylate monomer unit of the formula (1) where $R^1$ is hydrogen or a methyl group, and $R^2$ is a C4-7 linear or branched chain alkyl group.

Each of the polymer (B2) may optionally further comprise (B2f) at least one alkyl (meth)acrylate monomer unit having a linear chain or branched chain alkyl group, the alkyl group having at least 37 carbons (hereinafter may be simply referred to as "monomer unit (B2f)"). In view of further improvement in the fatigue life of a bearing, and further reduction of wear of a vane pump, the content of the monomer unit (B2f) in each of the polymer (B2) (the total content of the monomer units (B2f) when two or more monomer units (B2f) are comprised) is preferably less than 3 mol %, and more preferably less than 1 mol %, and may be 0 mol %, on the basis of the total monomer units in each of the polymer (B2). The monomer unit (B2f) is represented as a (meth)acrylate monomer unit of the formula (1) where $R^1$ is hydrogen or a methyl group, and $R^2$ is a linear chain or branched chain alkyl group, the alkyl group having at least 37 carbons.

Each of the polymer (B2) may optionally further comprise (B2g) at least one alkyl (meth)acrylate monomer unit having a C19-36 linear chain or branched chain alkyl group (hereinafter may be simply referred to as "monomer unit (B2g)"). In view of further improvement in the fatigue life of a bearing, and further reduction of wear of a vane pump, the content of the monomer unit (B2g) in each of the polymer (B2) (the total content of the monomer units (B2g) when two or more monomer units (B2g) are comprised) is preferably no more than 10 mol %, and more preferably no more than 5 mol %, on the basis of the total monomer units in each of the polymer (B2). The monomer unit (B2g) is represented as a (meth)acrylate monomer unit of the formula (1) where $R^1$ is hydrogen or a methyl group, and $R^2$ is a C19-36 linear chain or branched chain alkyl group.

Each of the polymer (B2) may optionally further comprise (B2h) at least one monomer unit other than a (meth)acrylate monomer unit (hereinafter may be simply referred to as "monomer unit (B2h)"). Preferred examples of a radically polymerizable comonomer through which the monomer unit (B2h) is present include α-olefins, and α,β-unsaturated dicarboxylic acid diesters. At least one monomer selected from them may be preferably used. In view of further improvement in the fatigue life of a bearing, and further reduction of wear of a vane pump, the content of the monomer unit (B2h) in each of the polymer (B2) (the total content of the monomer units (B2h) when two or more monomer units (B2h) are comprised) is preferably less than 10 mol %, and more preferably less than 5 mol %, on the basis of the total monomer units in each of the polymer (B2). An α-olefin through which the monomer unit (B2h) is present may be a linear chain α-olefin, or may be a branched chain α-olefin. The carbon number of the α-olefin through which the monomer unit (B2h) is present is preferably 2 to 18, and more preferably 2 to 10. In the present description, "α,β-unsaturated dicarboxylic acid" means a compound that is an unsaturated dicarboxylic acid where the α carbon and the β carbon of at least one carboxy group form an ethylenically unsaturated bond (that is, C=C double bond). That is, "α,β-unsaturated dicarboxylic acid" encompasses not only a dicarboxylic acid where the α carbon and the β carbon of each of both carboxy groups form an ethylenically unsaturated bond and the α,β-ethylenically unsaturated bond is present in the main chain (such as maleic acid, fumaric acid, citraconic acid and mesaconic acid), but also a dicarboxylic acid where the α carbon and the β carbon of only one carboxy group form an ethylenically unsaturated bond (such as glutaconic acid) and a dicarboxylic acid where an α,β-ethylenically unsaturated bond is found in a side chain (such as itaconic acid). Preferred examples of an α,β-unsaturated dicarboxylic acid constituting the α,β-unsaturated dicarboxylic acid diester through which the monomer unit (B2h) is present include maleic acid, fumaric acid, citraconic acid, and mesaconic acid. As an alcohol constituting the α,β-unsaturated dicarboxylic acid diester through which the monomer unit (B2h) is present, a linear chain or branched chain alkyl alcohol is preferable, and the carbon number thereof is preferably 1 to 36, and more preferably 4 to 18. Preferred examples of the α,β-unsaturated dicarboxylic acid diester through which the monomer unit (B2h) is present include diesters of at least one α,β-unsaturated dicarboxylic acid selected from maleic acid, fumaric acid, citraconic acid and mesaconic acid, and a C1-36 linear chain or branched chain alkyl alcohol. In the present description, any polymer comprising the monomer unit (B2h) in an amount of less than 10 mol % on the basis of the total monomer units shall fall under the polymer (B2) still as long as satisfying the other requirements for the polymer (B2).

The weight average molecular weight of each of the polymer (B2) is no more than 20,000, and more preferably no more than 15,000, in view of improvement in shift shock prevention properties and the fatigue life of a bearing, and reduction of wear of a vane pump; and no less than 5,000 in one embodiment in view of further improvement in the viscosity index of the lubricating oil composition; and may be 5,000 to 12,000 in one embodiment.

The production method of the polyalkyl (meth)acrylate (B2) is not particularly limited. For example, the polyalkyl (meth)acrylate (B2) may be easily obtained by radical solution polymerization of a raw material monomer comprising the monomer (M-1) corresponding to the monomer unit (B2a) in the presence of a polymerization initiator (such as benzoyl peroxide).

The component (B) functions as a viscosity index improver. The component (B) may be contained in the lubricating oil composition in such an amount that the kinematic viscosity of the lubricating oil composition at 100° C. is within the range described later. In one embodiment, the content of the component (B) in the lubricating oil composition on the basis of the total mass (100 mass %) of the lubricating oil composition is preferably no less than 0.01 mass %, and more preferably no less than 0.2 mass %, and in one embodiment, no less than 0.5 mass %, in view of further improvement in shift shock prevention properties, the fatigue life of a bearing, and the torque capacity of a clutch, and further reduction of wear of a vane pump; and preferably no more than 5 mass %, and no more than 3 mass % in one embodiment, in view of increase in the torque capacity of a clutch; and may be 0.01 to 5 mass % in one embodiment, may be 0.2 to 5 mass % in another embodiment, may be 0.2 to 3 mass % in another embodiment, and may be 0.5 to 3 mass % in another embodiment.

The polymer (B2) is preferably used as the component (B) in view of further improvement in shift shock prevention properties and the fatigue life of a bearing than a composition using any other polymer having the same weight average molecular weight, and further reduction of wear of a vane pump. When the polymer (B2) is used as the component (B), the content of the polymer (B2) (the total content of the polymers (B2) when two or more polymers (B2) are comprised) on the basis of the total mass of the composition is preferably no less than 0.2 mass %, and in one embodiment, no less than 0.5 mass %, in view of further improvement in shift shock prevention properties, the fatigue life of a bearing, and the torque capacity of a clutch, and further reduction of wear of a vane pump; and preferably no more than 5 mass %, and no more than 3 mass % in one embodiment, in view of further increase in the torque capacity of a clutch; and may be 0.2 to 5 mass % in one embodiment, may be 0.2 to 3 mass % in another embodiment, and may be 0.5 to 3 mass % in another embodiment.

(C) Calcium Sulfonate Detergent

In one embodiment, the lubricating oil composition may further comprise a calcium sulfonate detergent (hereinafter may be referred to as "component (C)"). As the component (C), one may be used alone, or two or more may be used in combination.

Preferred examples of the calcium sulfonate detergent include: calcium salts of alkylaromatic sulfonic acids obtainable by sulfonating alkylaromatic compounds, based salts thereof, or overbased salts thereof. The weight average molecular weight of the alkylaromatic compound is preferably 140 to 1500, and more preferably 230 to 800.

Examples of the alkylaromatic sulfonic acid include what is called petroleum sulfonic acids and synthetic sulfonic acids. Examples of petroleum sulfonic acids here include sulfonated products of alkylaromatic compounds of lubricant oil fractions derived from a mineral oil, and what is called mahogany acid, which is side product of a white oil. Examples of the synthetic sulfonic acid include sulfonated products of alkylbenzene having a linear chain or branched alkyl group, which is obtainable by: recovering side product in a manufacturing plant of alkylbenzene, which is raw material of detergents; or alkylating benzene with a polyolefin. Another example of the synthetic sulfonic acid is a sulfonated product of alkylnaphthalenes such as dinonylnaphthalene. A sulfonating agent used when sulfonating these alkylaromatics is not specifically limited. For example, fuming sulfuric acid or sulfuric anhydride may be used.

In one embodiment, the alkyl aromatic sulfonic acid may be an alkylbenzene sulfonic acid obtainable by sulfonating alkylbenzene that is obtained by alkylating benzene with a linear chain α-olefin. In this alkylbenzene sulfonic acid, the alkyl group is a branched chain alkyl group having a branch only at the α-position (carbon atom directly bonded to the benzene ring). Such an alkylbenzene sulfonic acid is represented by the following general formula (5).

(5)

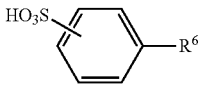

In the general formula (5), the sulfo substituent is at the o-position or p-position of $R^6$, and $R^6$ is represented by the following general formula (6).

(6)

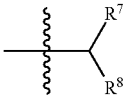

In the general formula (6), $R^7$ and $R^8$ are each independently a linear chain alkyl group having at least one carbon. The total carbon number of $R^7$ and $R^8$ is equal to (the carbon number of $R^6$-1), and the carbon number of $R^6$ is equal to the carbon number of the linear chain α-olefin. The carbon number of the linear chain α-olefin is preferably 5 to 36. In the alkylation reaction, the position of the C═C double bond in the linear chain α-olefin may change by isomerization. Generally, alkylation of benzene with an olefin gives an alkylbenzene having a structure such that an aromatic ring is bonded to one carbon atom of the C═C double bond of the olefin and a hydrogen atom is bonded to the other carbon atom thereof. In one embodiment, $R^7$ is a C1-4 linear chain alkyl group including the carbon at the 1-position (α-position) of the linear chain α-olefin, and $R^8$ is a linear chain alkyl group having at least one carbon and including the carbon at the ω-position of the linear chain α-olefin.

In one preferred embodiment, the alkyl aromatic sulfonic acid may be an alkylbenzene sulfonic acid obtainable by sulfonating alkylbenzene that is obtained by alkylating benzene with an oligomer of an olefin (olefin oligomer), the olefin having at least 3 carbons. In this alkylbenzene sulfonic acid, the alkyl group is a branched chain alkyl group having a branch not only at the α-position (carbon atom directly bonded to the benzene ring) but also (a) position(s) other than the α-position. The olefin oligomer is preferably an oligomer of a C3 or C4 olefin (such as propene, 1-butene, 2-butene and isobutene). The olefin oligomer may be a co-oligomer of two or more olefins. Such an alkylbenzene sulfonic acid is represented by the following general formula (7).

(7)

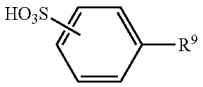

In the general formula (7), the sulfo substituent is at the o-position or p-position of $R^9$, and $R^9$ is represented by the following general formula (8).

(8)

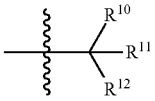

In the general formula (8), $R^{10}$ to $R^{12}$ are each independently a linear chain or branched chain alkyl group having at least one carbon, or a hydrogen atom. At least two of $R^{10}$ to $R^{12}$ are alkyl groups. At least one of $R^{10}$ to $R^{12}$ is a branched chain alkyl group. The total carbon number of $R^{11}$ to $R^{12}$ is equal to (the carbon number of $R^9$-1). The carbon number of $R^9$ is equal to the carbon number of the olefin oligomer. The polymerization degree of the olefin oligomer is preferably 2 to 20, and more preferably 3 to 12.

In view of further improvement in the fatigue life of a bearing and the torque capacity of a clutch, and further reduction of wear of a vane pump, a calcium sulfonate detergent comprising an alkyl group derived from an oligomer of an olefin, the olefin having at least 3 carbons is preferably used as the component (C). Generally, an olefin oligomer has a C═C double bond at an end of the main chain or the vicinity thereof. In the alkylation reaction, however, the position of a C=C double bond in the olefin oligomer may change by isomerization. Generally, alkylation of benzene with an olefin oligomer gives an alkylbenzene having a structure such that an aromatic ring is bonded to one carbon atom of a C=C double bond of the olefin oligomer, and a hydrogen atom is bonded to the other carbon atom the C=C double bond. In one embodiment, $R^{10}$ is a branched chain alkyl group including one end of the main chain of the olefin oligomer, $R^{11}$ is a linear chain or branched chain alkyl group including the other end of the main chain of the olefin oligomer, or a side chain alkyl group of the olefin oligomer, and $R^{12}$ is a hydrogen atom, or a side chain alkyl group of the olefin oligomer.

The base number of the component (C) is not particular limited, but is preferably 50 to 500 mgKOH/g, more preferably 100 to 400 mgKOH/g, and especially preferably 200 to 400 mgKOH/g. In the present description, a base number means a base number measured by the perchloric acid method, conforming to ASTM D 2896.

The lubricating oil composition may optionally comprise the component (C). When the lubricating oil composition comprises the component (C), the content thereof is preferably 10 to 1000 mass ppm, more preferably 40 to 600 mass ppm, and in one embodiment, may be 50 to 500 mass ppm, on the basis of the total mass of the lubricating oil composition in terms of calcium in view of further improvement in shift shock prevention properties, the fatigue life of a bearing, and the torque capacity of a clutch, and further reduction of wear of a vane pump.

(D) Phosphorus-Containing Additive

In one preferred embodiment, the lubricating oil composition may comprise a phosphorus-containing additive (hereinafter may be referred to as "component (D)"). As the component (D), one may be used alone, or two or more may be used in combination.

Any phosphorus-containing anti-wear agent usually used for a lubricating oil may be used as the component (D) without specific limitation. Examples of such a phosphorus-containing anti-wear agent include compounds represented by the following general formula (9), compounds represented by the following general formula (10), and metal salts and ammonium salts thereof. At least one compound selected from them may be preferably used as the component (D).

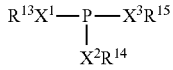

(9)

In the general formula (9), $X^1$, $X^2$ and $X^3$ are each independently an oxygen atom or a sulfur atom; $R^{13}$ represents a C1-30 hydrocarbon group that may include a sulfur atom; $R^{14}$ and $R^{15}$ each independently represent C1-30 a hydrocarbon group that may include a sulfur atom, or a hydrogen atom; and $R^{13}$, $R^{14}$ and $R^{15}$ may be the same as or different from each other. When $R^{14}$ and/or $R^{15}$ is/are (a) hydrogen atom(s), the compound of the general formula (9) usually has tautomerism. In the present description, any tautomers of the compound of the general formula (9) shall fall under the component (D).

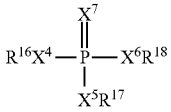

(10)

In the general formula (10), $X^4$, $X^5$, $X^6$ and $X^7$ are each independently an oxygen atom or a sulfur atom; $R^{16}$ represents a C1-30 hydrocarbon group that may include a sulfur atom; $R^{17}$ and $R^{18}$ each independently represent a C1-30 hydrocarbon group that may include a sulfur atom, or a hydrogen atom; and $R^{16}$, $R^{17}$ and $R^{18}$ may be the same as or different from each other.

Examples of the C1-30 hydrocarbon group in the general formulae (9) and (10) include an alkyl group, a cycloalkyl group, an alkenyl group, an alkyl-substituted cycloalkyl group, an aryl group, an alkyl-substituted aryl group, and an arylalkyl group. The hydrocarbon group is preferably a C1-30 alkyl group or a C6-24 aryl group, and in one embodiment, a C3-18, further preferably a C4-12 alkyl group, aryl group, or arylalkyl group.

The C1-30 hydrocarbon group in the general formulae (9) and (10) may be a hydrocarbon group including a sulfur atom, and may be a hydrocarbon group including no sulfur atom.

In one embodiment, preferred examples of the hydrocarbon group including no sulfur atom include C4-18 linear chain alkyl groups. Examples of the C4-18 linear chain alkyl groups include butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, and octadecyl group.

Examples of the hydrocarbon group including a sulfur atom include hydrocarbon groups functionalized by a sulfide bond. Preferred examples of the hydrocarbon group functionalized by a sulfide bond include C4-20 groups represented by the following general formula (11).

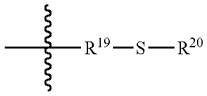

(11)

In the general formula (11), $R^{19}$ is a C2-17 linear chain hydrocarbon group, preferably an ethylene group or a propylene group, and in one embodiment, an ethylene group. $R^{20}$ is a C2-17 linear chain hydrocarbon group, preferably a C2-16 linear chain hydrocarbon group, and especially preferably a C6-10 linear chain hydrocarbon group.

Preferred examples of the group represented by the general formula (11) include 3-thiapentyl group, 3-thiahexyl group, 3-thiaheptyl group, 3-thiaoctyl group, 3-thianonyl group, 3-thiadecyl group, 3-thiaundecyl group, and 4-thiahexyl group.

Specific examples of a metal constituting a metal salt along with any phosphorus compound represented by the general formula (9) or (10) include alkali metals such as lithium, sodium, potassium and cesium, alkali earth metals such as calcium, magnesium and barium, and heavy metals such as zinc, copper, iron, lead, nickel, silver, and manganese. Among them, an alkali earth metal such as calcium and magnesium, or zinc, or any combination thereof is preferable.

Examples of a nitrogen-containing compound constituting an ammonium salt together with any phosphorus compound represented by the general formula (9) or (10) include ammonia, monoamines, diamines, polyamines and alkanolamines. More specific examples of such a nitrogen-containing compound include nitrogen-containing compounds represented by the following general formula (12); alkylene diamine such as methylenediamine, ethylenediamine, propylene diamine, and butylenediamine; polyamines such as diethylenetriamine, triethylenetetramine, tetraethylenepentamine, and pentaethylenehexamine; and combinations thereof.

(12)

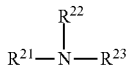

In the general formula (12), $R^{21}$ to $R^{23}$ each independently represent a hydrogen atom, a C1-8 hydrocarbyl group, or a C1-8 hydrocarbyl group having hydroxy group; and at least one of $R^{21}$ to $R^{23}$ is a C1-8 hydrocarbyl group, or a C1-8 hydrocarbyl group having hydroxy group.

Preferred examples of the compound represented by the general formula (9) include phosphite ester compounds of the general formula (9) where $X^1$ to $X^3$ are oxygen atoms, $R^{13}$ to $R^{15}$ are each independently a C3-18 (preferably C4-12) alkyl group, aryl group (such as phenyl group), or alkylaryl group (such as alkylphenyl group such as cresyl group) which may include a sulfur atom; hydrogen phosphite compounds of the general formula (9) where $X^1$ to $X^3$ are oxygen atoms, $R^{13}$ and $R^{14}$ are each independently a C3-18 (preferably C4-12) alkyl group, aryl group (such as phenyl group), or alkylaryl group (such as alkylphenyl group such as cresyl group) which may include a sulfur atom, and $R^{15}$ is hydrogen; hydrogen thiophisphite compounds of the general formula (9) where two of $X^1$ to $X^3$ are oxygen atoms and the rest thereof is a sulfur atom, $R^{13}$ and $R^{14}$ are each independently a C3-18 (preferably C4-12) alkyl group, aryl group (such as phenyl group), or alkylaryl group (such as alkylphenyl group such as cresyl group) which may include a sulfur atom, and $R^{15}$ is hydrogen; and hydrogen thiophosphite compounds of the general formula (9) where one of $X^1$ to $X^3$ is an oxygen atom and the rest two thereof are sulfur atoms, $R^{13}$ and $R^{14}$ are each independently a C3-18 (preferably C4-12) alkyl group, aryl group (such as phenyl group), or alkylaryl group (such as alkylphenyl group such as cresyl group) which may include a sulfur atom, and $R^{15}$ is hydrogen.

Preferred examples of the compound represented by the general formula (10) include dithiophosphate compounds of the general formula (10) where two of $X^4$ to $X^7$ are sulfur atoms and the rest two thereof are oxygen atoms, and $R^{16}$ to $R^{18}$ are each independently a C3-18 (preferably 4-12) alkyl group, aryl group (such as phenyl group), or alkylaryl group (such as cresyl group) which may include a sulfur atom.

One of these compounds may be used alone, or two or more of them may be used in combination.

When the lubricating oil composition comprises the component (D), the content thereof is preferably 50 to 800 mass ppm, more preferably 50 to 600 mass ppm, and in one embodiment, may be 50 to 500 mass ppm, on the basis of the total mass of the lubricating oil composition in terms of phosphorus in view of further improvement in anti-wear performance, anti-seizure performance, the fatigue life of a bearing, and shift shock prevention properties, and further reduction of wear of a vane pump.

(E) Succinimide Ashless Dispersant

In one preferred embodiment, the lubricating oil composition may further comprise a succinimide ashless dispersant (hereinafter may be referred to as "component (E)").

Preferred examples of the component (E) include succinimide having at least one alkyl or alkenyl group in its molecule, and/or derivatives (modified compounds) thereof.

Examples of succinimide having at least one alkyl or alkenyl group in its molecule include compounds represented by the following general formula (13) or (14).

(13)

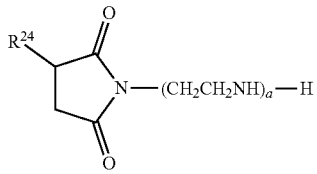

(14)

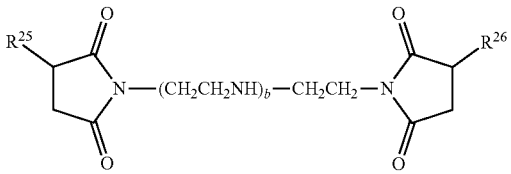

In the general formula (13), $R^{24}$ represents a C40-400 alkyl or alkenyl group, and a is an integer of 1 to 5, preferably 2 to 4. The carbon number of $R^{24}$ is preferably no less than 40, and more preferably no less than 60, in view of improvement in solubility of additives; and preferably no more than 400, and more preferably no more than 350, in view of improvement in low-temperature fluidity of the lubricating oil composition. $R^{24}$ is particularly preferably a polybutenyl group.

In the general formula (14), $R^{25}$ and $R^{26}$ each independently represent a C40-400 alkyl or alkenyl group, and may be any combination of different groups. b is an integer of 0 to 4, preferably 1 to 4, and more preferably 1 to 3. The carbon numbers of $R^{25}$ and $R^{26}$ are preferably no less than 40, and more preferably no less than 60, in view of improvement in solubility of additives; and preferably no more than 400, and more preferably no more than 350, in view of improvement in low-temperature fluidity of the lubricating oil composition. $R^{25}$ and $R^{26}$ are particularly preferably polybutenyl groups.

The alkyl or alkenyl groups ($R^{24}$ to $R^{26}$) in the formulae (13) and (14) may be linear chains or branched. Preferred examples thereof include branched alkyl groups and branched alkenyl groups which are derived from an oligomer of an olefin such as propylene, 1-butene and isobutene, or from co-oligomers of ethylene and propylene. Among them, a branched alkyl or alkenyl group derived from an oligomer of isobutene which is conventionally referred to as polyisobutylene, or a polybutenyl group is most preferable.

Preferred number average molecular weights of the alkyl or alkenyl groups ($R^{24}$ to $R^{26}$) in the formulae (13) and (14) are 800 to 3500, and more preferably 1000 to 3500.

The succinimide having at least one alkyl or alkenyl group in its molecule encompasses so-called mono-type succinimide such that succinic anhydride terminates only one end of the polyamine chain, which is represented by the formula (13), and so-called bis-type succinimide such that succinic anhydride terminates both ends of the polyamine chain, which is represented by the formula (14). The lubricating oil composition may comprise either mono-type or bis-type succinimide, or may comprise both of them as a mixture. The content of bis-type succinimide or any derivative thereof in the component (E) is preferably no less than 50 mass %, and more preferably no less than 70 mass %, on the basis of the total mass (100 mass %) of the composition (E).

The method for producing the succinimide having at least one alkyl or alkenyl group in its molecule is not specifically limited. For example, reaction of alkyl or alkenyl succinic acid having a C40-400 alkyl or alkenyl group, or an anhydride thereof, with a raw material polyamine can lead to obtainment of succinimide corresponding thereto as a condensation reaction product (condensation product). The alkyl or alkenyl succinic acid, or an anhydride thereof may be obtained by reaction of a compound having a C40-400 alkyl or alkenyl group with maleic anhydride at 100 to 200° C. As the component (F), the foregoing condensation product may be used as it is, or may be converted into a derivative described later and used. The condensation product of alkyl or alkenyl succinic acid, or an anhydride thereof, and a polyamine may be bistype succinimide where both ends of the polyamine chain are imidated (see the general formula (14)), may be monotype succinimide where only one end of the polyamine chain is imidated (see the general formula (13)), or may be a mixture thereof. Here, examples of a polyamine include diethylenetriamine, triethylenetetramine, tetraethylenepentamine, and pentaethylenehexamine, and any mixtures thereof. A raw material polyamine comprising at least one selected from them may be preferably used. The raw material polyamine may optionally further comprise ethylenediamine. In view of improvement of the performance of the condensation product or any derivative thereof as a dispersant, the content of ethylenediamine in the raw material polyamine is preferably 0 to 10 mass %, and more preferably 0 to 5 mass %, on the basis of the total mass of a polyamine. Succinimide obtained as a condensation reaction product of alkyl or alkenyl succinic acid having a C40-400 alkyl or alkenyl group, or an anhydride thereof, with a mixture of at least two polyamines is a mixture of compounds of the general formula (13) or (14) different in values of a or b, respectively.

Examples of the derivatives (modified compounds) of succinimide include (i) oxygen-containing organic compound—modified products where a part or all of the residual amino groups and/or imino groups is/are neutralized or amidated by making a C1-30 monocarboxylic acid such as fatty acids, a C2-30 polycarboxylic acid (such as ethanedioic acid, phthalic acid, trimellitic acid, and pyromellitic acid), an anhydride or ester thereof, a C2-6 alkylene oxide, or a hydroxy(poly)oxyalkylene carbonate react with the above described succinimide; (ii) boron-modified products where a part or all of the residual amino groups and/or imino groups is/are neutralized or amidated by making boric acid react with the above described succinimide; (iii) phosphoric acid-modified products where a part or all of the residual amino groups and/or imino groups is/are neutralized or amidated by making the above described succinimide react with phosphoric acid; (iv) sulfur-modified products obtained by making a sulfur compound react with the above described succinimide; and (v) modified products obtained by at least two modifications selected from the oxygen-containing organic compound modification, boron modification, phosphoric acid modification, and sulfur modification, on the above described succinimide in combination.

The weight average molecular weight of the component (E) is preferably 1000 to 20000, more preferably 1000 to 15000, and especially preferably 2000 to 9000.

When the lubricating oil composition comprises the component (E), the content thereof on the basis of the total mass of the lubricating oil composition is preferably no less than 0.2 mass %, more preferably no less than 0.5 mass %, and in one embodiment, no less than 1 mass %, in view of further improvement in shift shock prevention properties, the fatigue life of a bearing, the torque capacity of a clutch, and an anti-coking property (thermal stability) of the lubricating oil composition; and preferably no more than 8 mass %, more preferably no more than 6 mass %, and no more than 5 mass % in one embodiment, in view of further improvement in the fatigue life of a bearing, fuel efficiency, and the torque capacity of a clutch; and may be 0.2 to 8 mass % in one embodiment, may be 0.5 to 6 mass % in another embodiment, and may be 1 to 5 mass % in another embodiment.

When the boron-modified product is used as the component (E), the boron content derived from the component (E) in the lubricating oil composition on the basis of the total mass of the lubricating oil composition is preferably no less than 0.001 mass %, and more preferably no less than 0.003 mass %, in view of further improvement in shift shock prevention properties, the fatigue life of a bearing, the torque capacity of a clutch, and anti-wear performance; and preferably no more than 0.05 mass %, and more preferably no more than 0.03 mass %, in view of improvement in anti-wear performance and anti-seizure performance; and may be 0.001 to 0.05 mass % in one embodiment, and may be no more than 0.003 to 0.03 mass % in another embodiment.

(F) Amine Friction Modifier

In one embodiment, the lubricating oil composition preferably comprises substantially no (F) amine friction modifier (hereinafter may be referred to as "component (F)") in view of further improvement in the torque capacity of a clutch. In the present description, "comprising substantially no amine friction modifier" means that the lubricating oil composition does not comprise any component used as an amine friction modifier in a lubricating oil at all, or that the content thereof is so low that the influence thereof can be ignored. The component used as an amine friction modifier in a lubricating oil is an amine compound having at least one C9-50 alkyl or alkenyl group, and at least one primary or secondary amino group bonded to an aliphatic carbon in its molecule. Such an amine compound is known as an amine friction modifier. The amine friction modifier may be an alkylene oxide adduct of a primary amine. The alkylene oxide adduct of the primary amine has a secondary amino group and a hydroxy group as functional groups. More specifically, the content of the amine friction modifier in the lubricating oil composition is preferably 0 to 50 mass ppm, more preferably 0 to 20 mass ppm, further preferably 0 to 10 mass ppm, and especially preferably 0 to 5 mass ppm, and in one embodiment, may be 0 to 50 mass ppm.

<Other Additives>

In one embodiment, the lubricating oil composition may further comprise at least one additive selected from an anti-wear agent or extreme-pressure agent other than the component (D), an antioxidant, a pour point depressant other than the component (B), a corrosion inhibitor, an anti-rust agent, a metal deactivator, a defoaming agent, a demulsifier, and a coloring agent.

Examples of an anti-wear agent or extreme-pressure agent other than the component (D) include sulfur-based compounds such as disulfides, sulfurized olefins, and sulfurized oils. When the lubricating oil composition comprises an anti-wear agent or extreme-pressure agent other than the component (D), the content thereof may be, for example, 0.01 to 5 mass % on the basis of the total mass of the lubricating oil composition.

Examples of the antioxidant include phenolic or amine ashless antioxidants, and copper or molybdenum metallic antioxidants. Specific examples of the phenolic ashless antioxidant include 4,4'-methylenebis(2,6-di-tert-butylphenol), and 4,4'-bis(2,6-di-tert-butylphenol); and examples of the amine ashless antioxidant include phenyl-α-naphthylamine, alkylphenyl-α-naphthylamine, and dialkyldiphenylamine. When the lubricating oil composition comprises the antioxidant, the content thereof may be, for example, 0.01 to 5 mass % on the basis of the total mass of the lubricating oil composition.

For example, a known pour point depressant such as a polymethacrylate polymer that does not fall under the component (B) may be used as a pour point depressant other than the component (B) according to properties of the lubricant base oil to be used. When the lubricating oil composition comprises the pour point depressant other than the component (B), the content thereof may be, for example, 0.05 to 0.5 mass %, and in one embodiment, 0.05 to 0.3 mass %, on the basis of the total mass of the lubricating oil composition.

For example, any known corrosion inhibitor such as thiadiazole, benzotriazole, tolyltriazole, and imidazole compounds may be employed as the corrosion inhibitor. When the lubricating oil composition comprises the corrosion inhibitor, the content thereof is usually 0.005 to 5 mass % on the basis of the total mass of the lubricating oil composition.

Any known anti-rust agent such as petroleum sulfonate, alkylbenzenesulfonate, dinonylnaphthalenesulfonate, alkenylsuccinate esters, and polyol esters may be employed as the anti-rust agent. When the lubricating oil composition comprises the anti-rust agent, the content thereof is usually 0.005 to 5 mass % on the basis of the total mass of the lubricating oil composition.

Any known metal deactivator such as imidazoline, pyrimidine derivatives, mercaptobenzothiazole, benzotriazole and its derivatives, thiadiazole and its derivatives, 2-(alkyldithio)benzimidazole, and β-(o-carboxybenzylthio)propionitrile may be employed as the metal deactivator. When the lubricating oil composition comprises the metal deactivator, the content thereof is usually 0.005 to 1 mass % on the basis of the total mass of the lubricating oil composition.

Any known defoaming agent such as silicones, fluorosilicones, and fluoroalkyl ethers may be employed as the defoaming agent. When the lubricating oil composition comprises the defoaming agent, the content thereof is usually 0.0005 to 1 mass % on the basis of the total mass of the lubricating oil composition.

Any known demulsifier such as polyalkylene glycol nonionic surfactants may be employed as the demulsifier. When the lubricating oil composition comprises the demulsifier, the content thereof is usually 0.005 to 5 mass % on the basis of the total mass of the lubricating oil composition.

As the coloring agent, any known coloring agent such as azo compounds may be employed.

<Lubricating Oil Composition>

The kinematic viscosity of the lubricating oil composition at 100° C. is no less than 2.5 $mm^2/s$, preferably no less than 2.7 $mm^2/s$, and in one embodiment, no less than 2.9 $mm^2/s$, in view of sufficient oil film formation at a lubricating point to improve anti-wear performance; and no more than 4.9 $mm^2/s$, preferably no more than 4.4 $mm^2/s$, more preferably no more than 3.9 $mm^2/s$, and in one embodiment, no more than 3.7 $mm^2/s$, in view of improvement in fuel efficiency; and in one embodiment, may be 2.5 to 4.9 $mm^2/s$.

The kinematic viscosity of the lubricating oil composition at 40° C. is preferably no less than 9 $mm^2/s$, more preferably no less than 10 $mm^2/s$, and in one embodiment, no less than 11 $mm^2/s$, in view of sufficient oil film formation at a lubricating point to improve anti-wear performance; and preferably no more than 30 $mm^2/s$, more preferably no more than 25 $mm^2/s$, and in one embodiment, no more than 16 $mm^2/s$, in view of further improvement in fuel efficiency.

(Use)

The lubricating oil composition according to the present invention may be preferably used as an automatic transmission oil for automobiles, and may be particularly preferably used for lubrication of a transmission equipped with a wet clutch such as a multiplate wet clutch.

EXAMPLES

Hereinafter the present invention will be more specifically described based on examples and comparative examples. It is noted that the present invention is not limited to these examples.

Examples 1 to 31 and Comparative Examples 1 to 3

Lubricating oil compositions according to the present invention (examples 1 to 31) and lubricating oil compositions for comparison (comparative examples 1 to 3) were prepared as shown in tables 1 to 6. In tables, "mass %" in the item of "base oil composition" means mass % on the basis of the total mass (100 mass %) of the base oil, and "mass %" in the other items means mass % on the basis of the total mass (100 mass %) of the composition. In tables, "mass ppm/Ca" means mass ppm on the basis of the total mass of the composition in terms of calcium, and "mass ppm/P" means mass ppm on the basis of the total mass of the composition in terms of phosphorus. Details on the components are as follows:

((A) Lubricating Base Oil)

A-1: API Group III base oil, kinematic viscosity (100° C.): 2.7 $mm^2/s$, kinematic viscosity (40° C.): 9.6 $mm^2/s$, viscosity index: 125, sulfur content: less than 1 mass ppm, % $C_P$: 92.2, % $C_N$: 7.8, % $C_A$: 0

A-2: API Group II base oil, kinematic viscosity (100° C.): 3.1 $mm^2/s$, kinematic viscosity (40° C.): 12.7 $mm^2/s$, viscosity index: 105, sulfur content: less than 1 mass ppm, % $C_P$: 70.8, % $C_N$: 29.2, % $C_A$: 0

A-3: API Group I base oil, kinematic viscosity (100° C.): 2.1 $mm^2/s$, kinematic viscosity (40° C.): 6.87 $mm^2/s$, viscosity index: 96, sulfur content: 0.15 mass %, % $C_P$: 63, % $C_N$: 31, % $C_A$: 6

A-4: API Group IV base oil (DURASYN™ 162 manufactured by INEOS), kinematic viscosity (100° C.): 1.78 $mm^2/s$, kinematic viscosity (40° C.): 5.40 $mm^2/s$ A-5: API Group V base oil (bis(2-ethylhexyl) azelate), kinematic viscosity (100° C.): 2.9 $mm^2/s$, kinematic viscosity (40° C.): 10.3 $mm^2/s$ ((B) Polymer)

B-1: non-dispersant polyalkyl methacrylate, weight average molecular weight: 12,000, side chain alkyl group ($R^2$ in the general formula (1)): branched chain alkyl group and linear chain alkyl group, the carbon number of the side chain alkyl group: C12-15

B-2: non-dispersant polyalkyl methacrylate, weight average molecular weight: 20,000, side chain alkyl group ($R^2$ in the general formula (1)): combination of C1 (methyl group) (60 mol %), linear chain C12-16 alkyl group (20 mol %), and branched chain C22 alkyl group (20 mol %)

B-3: non-dispersant polyalkyl methacrylate, weight average molecular weight: 20,000, side chain alkyl group ($R^2$ in the general formula (1)): combination of C1 (methyl group) (45 mol %), and linear chain C12-15 alkyl group (55 mol %)

B'-4: non-dispersant polyalkyl methacrylate, weight average molecular weight: 35,000, side chain alkyl group ($R^2$ in the general formula (1)): combination of branched chain alkyl group and linear chain alkyl group, the carbon number of the side chain alkyl group: C1, C12-16, C18 and C22 in combination B'-5: ethylene propylene copolymer, weight average molecular weight: 13,000

B-6: non-dispersant polyalkyl methacrylate, weight average molecular weight: 8,000, side chain alkyl group ($R^2$ in the general formula (1)): branched chain C6 (2-methylpentyl group) (15 mol %), branched chain C8 (2-ethylhexyl group) (5 mol %), linear chain C12-15 alkyl group (45 mol %), and branched chain C12-15 alkyl group (35 mol %)

B-7: non-dispersant polyalkyl methacrylate, weight average molecular weight: 5,000, side chain alkyl group ($R^2$ in the general formula (1)): branched chain alkyl group and linear chain alkyl group, the carbon number of the side chain alkyl group: C12-15

B-8: non-dispersant polyalkyl methacrylate, weight average molecular weight: 8,000, side chain alkyl group ($R^2$ in the general formula (1)): branched chain C8 alkyl group B-9: non-dispersant polyalkyl methacrylate, weight average molecular weight: 8,000, side chain alkyl group ($R^2$ in the general formula (1)): linear chain C18 alkyl group ((C) Calcium Sulfonate Detergent)

C-1: a Ca sulfonate that was an overbased salt of a Ca salt of an alkylbenzene sulfonic acid obtained by sulfonating an alkylbenzene that was obtained by alkylating benzene with an isobutene oligomer (tetramer to heptamer) (mixture of: Ca sulfonates that were overbased salts of Ca salts of alkylbenzene sulfonic acids of the general formulae (7) and (8) wherein $R^{10}$ was a branched chain alkyl group including one end of the main chain of the isobutene oligomer ($—CH_2—(C(CH_3)_2—CH_2)_{n-1}—H$ group wherein n was the polymerization degree of the isobutene oligomer), and $R^{11}$ and $R^{12}$ were methyl groups; and Ca sulfonates that were overbased salts of Ca salts of alkylbenzene sulfonic acids of the general formulae (7) and (8) wherein $R^{10}$ was a branched chain alkyl group including one end of the main chain of the isobutene oligomer ($—(C(CH_3)_2—CH_2)_{n-1}—H$ group wherein n was the polymerization degree of the isobutene oligomer), $R^{11}$ was a branched chain alkyl group including the other end of the main chain of the isobutene oligomer (isopropyl group), and $R^{12}$ was a hydrogen atom), base number 300 mgKOH/g, Ca: 10 mass %

C-2: a Ca sulfonate that was an overbased salt of a Ca salt of an alkylbenzene sulfonic acid obtained by sulfonating alkylbenzene that was obtained by alkylating benzene with a linear chain α-olefin (C20-26) (mixture of Ca sulfonates that were overbased salts of Ca salts of alkylbenzene sulfonic acids of the general formulae (5) and (6) wherein $R^7$ was a C1-4 linear chain alkyl group including the carbon at the 1-position of the linear chain α-olefin, and $R^8$ was a linear chain alkyl group including the carbon at the co-position of the linear chain α-olefin), base number 300 mgKOH/g, Ca: 12 mass %

((D) Phosphorus-Containing Additive)

D-1: trioctyl dithiophosphate (represented by the general formula (10), wherein two of $X^4$ to $X^7$ are oxygen atoms and the rest two are sulfur atoms, and $R^{16}$ to $R^{18}$ are octyl groups), P: 6.6 mass %

D-2: bis(3-thiaundecyl) hydrogen phosphite (in the general formula (9), $X^1$ to $X^3$ were oxygen atoms, $R^{13}$ and $R^{14}$ were 3-thiaundecyl group, and $R^{15}$ was hydrogen), P: 7.3 mass %

D-3: dibutyl hydrogen phosphite (in the general formula (9), $X^1$ to $X^3$ were oxygen atoms, $R^{13}$ and $R^{14}$ were butyl groups, and $R^{15}$ was hydrogen), P: 15.9 mass %

((E) Ashless Dispersant)

E-1: alkenyl succinimide ashless dispersant, the number average molecular weight of the alkenyl groups: 3000, N: 1.6 mass %

E-2: boron-modified alkenyl succinimide dispersant, the number average molecular weight of the alkenyl groups: 3000, N: 1.6 mass %, B: 0.6 mass %

((F) Amine Friction Modifier)

F-1: Oleylamine-Ethylene Oxide Adduct

Other additive: an additive package consisting of: an amine antioxidant (1 mass %), a phenolic antioxidant (1 mass %), a metal deactivator (0.1 mass %) and a pour point depressant (0.2 mass %) (the numeral value in the parentheses represent the content on the basis of the total mass of the lubricating oil composition)

TABLE 1

| | | Examples | | | | | |
|---|---|---|---|---|---|---|---|
| | | 1 | 2 | 3 | 4 | 5 | 6 |
| Base oil composition | | | | | | | |
| A-1 | mass % | 100 | — | 50 | 92 | 50 | 90 |
| A-2 | mass % | — | 100 | 50 | — | — | — |
| A-3 | mass % | — | — | — | 8 | — | — |
| A-4 | mass % | — | — | — | — | 50 | — |
| A-5 | mass % | — | — | — | — | — | 10 |
| Properties of the total base oil | | | | | | | |
| Kinematic viscosity (100° C.) | $mm^2/s$ | 2.7 | 3.1 | 2.9 | 2.6 | 2.2 | 2.7 |
| % $C_A$ | | 0 | 0 | 0 | 0.5 | 0 | 0 |
| (A) Total base oil | mass % | 94.3 | 94.3 | 94.3 | 94.3 | 94.3 | 94.3 |
| (B) Polymer | | | | | | | |
| B-1 | mass % | 1 | 1 | 1 | 1 | 1 | 1 |
| B-2 | mass % | — | — | — | — | — | — |
| B-3 | mass % | — | — | — | — | — | — |

TABLE 1-continued

| | | Examples | | | | | |
|---|---|---|---|---|---|---|---|
| | | 1 | 2 | 3 | 4 | 5 | 6 |
| B*-4 | mass % | — | — | — | — | — | — |
| B*-5 | mass % | — | — | — | — | — | — |
| B-6 | mass % | — | — | — | — | — | — |
| B-7 | mass % | — | — | — | — | — | — |
| B-8 | mass % | — | — | — | — | — | — |
| B-9 | mass % | — | — | — | — | — | — |
| (C) Ca sulfonate | | | | | | | |
| C-1 | mass ppm/Ca | 100 | 100 | 100 | 100 | 100 | 100 |
| C-2 | mass ppm/Ca | — | — | — | — | — | — |
| (D) P-containing additive | | | | | | | |
| D-1 | mass ppm/P | 200 | 200 | 200 | 200 | 200 | 200 |
| D-2 | mass ppm/P | — | — | — | — | — | — |
| D-3 | mass ppm/P | — | — | — | — | — | — |
| (E) Ashless dispersant | | | | | | | |
| E-1 | mass % | 2 | 2 | 2 | 2 | 2 | 2 |
| E-2 | mass % | — | — | — | — | — | — |
| (F) Amine friction modifier | | | | | | | |
| F-1 | mass % | — | — | — | — | — | — |
| Other additives | mass % | 2.3 | 2.3 | 2.3 | 2.3 | 2.3 | 2.3 |
| Properties of the composition | | | | | | | |
| Kinematic viscosity (40° C.) | $mm^2/s$ | 12.2 | 15.3 | 13.8 | 12.0 | 11.1 | 12.3 |
| Kinematic viscosity (100° C.) | $mm^2/s$ | 3.3 | 3.7 | 3.5 | 3.2 | 2.9 | 3.3 |
| SAE No. 2 test | | | | | | | |
| Shift shock preventing index $\mu_0/\mu_d$ | | 1.13 | 1.13 | 1.13 | 1.13 | 1.13 | 1.14 |
| Unisteel test | | | | | | | |
| Fatigue life L50 of a bearing | h | 33.2 | 21.9 | 26.4 | 30.8 | 21.3 | 36.1 |
| Vane pump wear test | | | | | | | |
| Wear amount of a vane pump | mg | 1.0 | 1.1 | 1.1 | 1.2 | 1.0 | 1.1 |
| Kinematic viscosity reduction (100° C.) | % | 0.0 | 0.0 | 0.0 | 0.0 | 0.0 | 0.0 |
| Shear stability test (Sonic, 2 h) | | | | | | | |
| Kinematic viscosity reduction (100° C.) | % | 3.6 | 3.5 | 3.5 | 3.6 | 3.7 | 3.6 |

TABLE 2

| | | Examples | | | | | |
|---|---|---|---|---|---|---|---|
| | | 7 | 8 | 9 | 10 | 11 | 12 |
| Base oil composition | | | | | | | |
| A-1 | mass % | 100 | 100 | 100 | 100 | 100 | 100 |
| A-2 | mass % | — | — | — | — | — | — |
| A-3 | mass % | — | — | — | — | — | — |
| A-4 | mass % | — | — | — | — | — | — |
| A-5 | mass % | — | — | — | — | — | — |
| Properties of the total base oil | $mm^2/s$ | 2.7 | 2.7 | 2.7 | 2.7 | 2.7 | 2.7 |
| Kinematic viscosity (100° C.) | | | | | | | |
| % $C_A$ | | 0 | 0 | 0 | 0 | 0 | 0 |
| (A) Total base oil | mass % | 94.8 | 93.3 | 92.3 | 90.3 | 95.1 | 94.3 |
| (B) Polymer | | | | | | | |
| B-1 | mass % | 0.5 | 2 | 3 | 5 | 0.2 | — |
| B-2 | mass % | — | — | — | — | — | 1 |
| B-3 | mass % | — | — | — | — | — | — |
| B*-4 | mass % | — | — | — | — | — | — |
| B*-5 | mass % | — | — | — | — | — | — |
| B-6 | mass % | — | — | — | — | — | — |
| B-7 | mass % | — | — | — | — | — | — |
| B-8 | mass % | — | — | — | — | — | — |
| B-9 | mass % | — | — | — | — | — | — |
| (C) Ca sulfonate | | | | | | | |
| C-1 | mass ppm/Ca | 100 | 100 | 100 | 100 | 100 | 100 |
| C-2 | mass ppm/Ca | — | — | — | — | — | — |

TABLE 2-continued

| | | Examples | | | | | |
|---|---|---|---|---|---|---|---|
| | | 7 | 8 | 9 | 10 | 11 | 12 |
| (D) P-containing additive | | | | | | | |
| D-1 | mass ppm/P | 200 | 200 | 200 | 200 | 200 | 200 |
| D-2 | mass ppm/P | — | — | — | — | — | — |
| D-3 | mass ppm/P | — | — | — | — | — | — |
| (E) Ashless dispersant | | | | | | | |
| E-1 | mass % | 2 | 2 | 2 | 2 | 2 | 2 |
| E-2 | mass % | — | — | — | — | — | — |
| (F) Amine friction modifier | | | | | | | |
| F-1 | mass % | — | — | — | — | — | — |
| Other additives | mass % | 2.3 | 2.3 | 2.3 | 2.3 | 2.3 | 2.3 |
| Properties of the composition | | | | | | | |
| Kinematic viscosity (40° C.) | $mm^2/s$ | 11.9 | 12.7 | 13.2 | 14.2 | 11.8 | 12.5 |
| Kinematic viscosity (100° C.) | $mm^2/s$ | 3.2 | 3.4 | 3.5 | 3.6 | 3.2 | 3.3 |
| SAE No. 2 test | | | | | | | |
| Shift shock preventing index $\mu_0/\mu_d$ | | 1.14 | 1.10 | 1.13 | 1.13 | 1.15 | 1.13 |
| Unisteel test | | | | | | | |
| Fatigue life L50 of a bearing | h | 31.7 | 31.4 | 30.5 | 28.0 | 22.4 | 23.7 |
| Vane pump wear test | | | | | | | |
| Wear amount of a vane pump | mg | 1.3 | 1.0 | 0.8 | 0.7 | 1.5 | 4.0 |
| Kinematic viscosity reduction (100° C.) | % | 0.0 | 0.0 | 0.0 | 0.0 | 0.0 | 0.0 |
| Shear stability test (Sonic, 2 h) | | | | | | | |
| Kinematic viscosity reduction (100° C.) | % | 2.9 | 3.8 | 3.9 | 4.2 | 3.4 | 3.8 |

TABLE 3

| | | Examples | | | | |
|---|---|---|---|---|---|---|
| | | 13 | 14 | 15 | 16 | 17 |
| Base oil composition | | | | | | |
| A-1 | mass % | 100 | 100 | 100 | 100 | 100 |
| A-2 | mass % | — | — | — | — | — |
| A-3 | mass % | — | — | — | — | — |
| A-4 | mass % | — | — | — | — | — |
| A-5 | mass % | — | — | — | — | — |
| Properties of the total base oil | | | | | | |
| Kinematic viscosity (100° C.) | $mm^2/s$ | 2.7 | 2.7 | 2.7 | 2.7 | 2.7 |
| % $C_A$ | | 0 | 0 | 0 | 0 | 0 |
| (A) Total base oil | mass % | 94.3 | 94.3 | 94.3 | 94.3 | 94.3 |
| (B) Polymer | | | | | | |
| B-1 | mass % | — | — | — | — | — |
| B-2 | mass % | — | — | — | — | — |
| B-3 | mass % | 1 | — | — | — | — |
| B*-4 | mass % | — | — | — | — | — |
| B*-5 | mass % | — | — | — | — | — |
| B-6 | mass % | — | 1 | — | — | — |
| B-7 | mass % | — | — | 1 | — | — |
| B-8 | mass % | — | — | — | 1 | — |
| B-9 | mass % | — | — | — | — | 1 |
| (C) Ca sulfonate | | | | | | |
| C-1 | mass ppm/Ca | 100 | 100 | 100 | 100 | 100 |
| C-2 | mass ppm/Ca | — | — | — | — | — |
| (D) P-containing additive | | | | | | |
| D-1 | mass ppm/P | 200 | 200 | 200 | 200 | 200 |
| D-2 | mass ppm/P | — | — | — | — | — |
| D-3 | mass ppm/P | — | — | — | — | — |
| (E) Ashless dispersant | | | | | | |
| E-1 | mass % | 2 | 2 | 2 | 2 | 2 |
| E-2 | mass % | — | — | — | — | — |

TABLE 3-continued

| | | Examples | | | | |
|---|---|---|---|---|---|---|
| | | 13 | 14 | 15 | 16 | 17 |
| (F) Amine friction modifier | | | | | | |
| F-1 | mass % | — | — | — | — | — |
| Other additives | mass % | 2.3 | 2.3 | 2.3 | 2.3 | 2.3 |
| Properties of the composition | | | | | | |
| Kinematic viscosity (40° C.) | $mm^2/s$ | 12.2 | 12.0 | 11.9 | 12.0 | 12.0 |
| Kinematic viscosity (100° C.) | $mm^2/s$ | 3.3 | 3.3 | 3.2 | 3.3 | 3.3 |
| SAE No. 2 test | | | | | | |
| Shift shock preventing index $\mu_0/\mu_d$ | | 1.13 | 1.13 | 1.13 | 1.13 | 1.13 |
| Unisteel test | | | | | | |
| Fatigue life L50 of a bearing | h | 19.8 | 32.8 | 32.4 | 30.7 | 31.3 |
| Vane pump wear test | | | | | | |
| Wear amount of a vane pump | mg | 4.2 | 1.1 | 1.2 | 1.4 | 1.3 |
| Kinematic viscosity reduction (100° C.) | % | 0.0 | 0.0 | 0.0 | 0.0 | 0.0 |
| Shear stability test (Sonic, 2 h) | | | | | | |
| Kinematic viscosity reduction (100° C.) | % | 3.8 | 3.5 | 3.4 | 3.5 | 3.5 |

TABLE 4

| | | Examples | | | | |
|---|---|---|---|---|---|---|
| | | 18 | 19 | 20 | 21 | 22 |
| Base oil composition | | | | | | |
| A-1 | mass % | 100 | 100 | 100 | 100 | 100 |
| A-2 | mass % | — | — | — | — | — |
| A-3 | mass % | — | — | — | — | — |
| A-4 | mass % | — | — | — | — | — |
| A-5 | mass % | — | — | — | — | — |
| Properties of the total base oil | | | | | | |
| Kinematic viscosity (100° C.) | $mm^2/s$ | 2.7 | 2.7 | 2.7 | 2.7 | 2.7 |
| % $C_A$ | | 0 | 0 | 0 | 0 | 0 |
| (A) Total base oil | mass % | 94.3 | 93.9 | 94.3 | 94.3 | 94.5 |
| (B) Polymer | | | | | | |
| B-1 | mass % | 1 | 1 | 1 | 1 | 1 |
| B-2 | mass % | — | — | — | — | — |
| B-3 | mass % | — | — | — | — | — |
| B*-4 | mass % | — | — | — | — | — |
| B*-5 | mass % | — | — | — | — | — |
| B-6 | mass % | — | — | — | — | — |
| B-7 | mass % | — | — | — | — | — |
| B-8 | mass % | — | — | — | — | — |
| B-9 | mass % | — | — | — | — | — |
| (C) Ca sulfonate | | | | | | |
| C-1 | mass ppm/Ca | 50 | 500 | — | 100 | 100 |
| C-2 | mass ppm/Ca | — | — | 100 | — | — |
| (D) P-containing additive | | | | | | |
| D-1 | mass ppm/P | 200 | 200 | 200 | — | — |
| D-2 | mass ppm/P | — | — | — | 200 | — |
| D-3 | mass ppm/P | — | — | — | — | 200 |
| (E) Ashless dispersant | | | | | | |
| E-1 | mass % | 2 | 2 | 2 | 2 | 2 |
| E-2 | mass % | — | — | — | — | — |
| (F) Amine friction modifier | | | | | | |
| F-1 | mass % | — | — | — | — | — |
| Other additives | mass % | 2.3 | 2.3 | 2.3 | 2.3 | 2.3 |
| Properties of the composition | | | | | | |
| Kinematic viscosity (40° C.) | $mm^2/s$ | 12.2 | 12.2 | 12.2 | 12.2 | 12.2 |
| Kinematic viscosity (100° C.) | $mm^2/s$ | 3.3 | 3.3 | 3.3 | 3.3 | 3.3 |

TABLE 4-continued

| | | Examples | | | | |
|---|---|---|---|---|---|---|
| | | 18 | 19 | 20 | 21 | 22 |
| SAE No. 2 test | | | | | | |
| Shift shock preventing index $\mu_0/\mu_d$ | | 1.14 | 1.15 | 1.10 | 1.14 | 1.13 |
| Unisteel test | | | | | | |
| Fatigue life L50 of a bearing | h | 31.9 | 29.8 | 31.8 | 34.5 | 31.2 |
| Vane pump wear test | | | | | | |
| Wear amount of a vane pump | mg | 1.1 | 1.1 | 1.1 | 1.3 | 1.3 |
| Kinematic viscosity reduction (100° C.) | % | 0.0 | 0.0 | 0.0 | 0.0 | 0.0 |
| Shear stability test (Sonic, 2 h) | | | | | | |
| Kinematic viscosity reduction (100° C.) | % | 3.5 | 3.6 | 3.5 | 3.5 | 3.6 |

TABLE 5

| | | Examples | | | | | |
|---|---|---|---|---|---|---|---|
| | | 23 | 24 | 25 | 26 | 27 | 28 |
| Base oil composition | | | | | | | |
| A-1 | mass % | — | 100 | 100 | 100 | 100 | 100 |
| A-2 | mass % | 100 | — | — | — | — | — |
| A-3 | mass % | — | — | — | — | — | — |
| A-4 | mass % | — | — | — | — | — | — |
| A-5 | mass % | — | — | — | — | — | — |
| Properties of the total base oil | | | | | | | |
| Kinematic viscosity (100° C.) | $mm^2/s$ | 3.1 | 2.7 | 2.7 | 2.7 | 2.7 | 2.7 |
| % $C_A$ | | 0 | 0 | 0 | 0 | 0 | 0 |
| (A) Total base oil | mass % | 94.8 | 94.5 | 93.8 | 95.3 | 91.3 | 94.3 |
| (B) Polymer | | | | | | | |
| B-1 | mass % | 0.5 | 1 | 1 | 1 | 1 | 1 |
| B-2 | mass % | — | — | — | — | — | — |
| B-3 | mass % | — | — | — | — | — | — |
| B*-4 | mass % | — | — | — | — | — | — |
| B*-5 | mass % | — | — | — | — | — | — |
| B-6 | mass % | — | — | — | — | — | — |
| B-7 | mass % | — | — | — | — | — | — |
| B-8 | mass % | — | — | — | — | — | — |
| B-9 | mass % | — | — | — | — | — | — |
| (C) Ca sulfonate | | | | | | | |
| C-1 | mass ppm/Ca | 100 | — | — | 100 | 100 | 100 |
| C-2 | mass ppm/Ca | — | 100 | 100 | — | — | — |
| (D) P-containing additive | | | | | | | |
| D-1 | mass ppm/P | 80 | 50 | 500 | 200 | 200 | 200 |
| D-2 | mass ppm/P | 120 | — | — | — | — | — |
| D-3 | mass ppm/P | — | — | — | — | — | — |
| (E) Ashless dispersant | | | | | | | |
| E-1 | mass % | 2 | 2 | 2 | 1 | 5 | — |
| E-2 | mass % | — | — | — | — | — | 2 |
| (F) Amine friction modifier | | | | | | | |
| F-1 | mass % | — | — | — | — | — | — |
| Other additives | mass % | 2.3 | 2.3 | 2.3 | 2.3 | 2.3 | 2.3 |
| Properties of the composition | | | | | | | |
| Kinematic viscosity (40° C.) | $mm^2/s$ | 12.3 | 12.2 | 12.2 | 12.2 | 12.8 | 12.2 |
| Kinematic viscosity (100° C.) | $mm^2/s$ | 3.1 | 3.3 | 3.3 | 3.3 | 3.4 | 3.3 |
| SAE No. 2 test | | | | | | | |
| Shift shock preventing index $\mu_0/\mu_d$ | | 1.13 | 1.14 | 1.11 | 1.12 | 1.14 | 1.10 |
| Unisteel test | | | | | | | |
| Fatigue life L50 of a bearing | h | 30.8 | 29.6 | 31.8 | 32.1 | 29.3 | 32.4 |

TABLE 5-continued

| | | Examples | | | | | |
|---|---|---|---|---|---|---|---|
| | | 23 | 24 | 25 | 26 | 27 | 28 |
| Vane pump wear test | | | | | | | |
| Wear amount of a vane pump | mg | 1.3 | 1.5 | 0.8 | 1.2 | 1.1 | 1.1 |
| Kinematic viscosity reduction (100° C.) | % | 0.0 | 0.0 | 0.0 | 0.0 | 0.0 | 0.0 |
| Shear stability test (Sonic, 2 h) | | | | | | | |
| Kinematic viscosity reduction (100° C.) | % | 2.9 | 3.5 | 3.5 | 2.8 | 4.2 | 3.5 |

TABLE 6

| | | Examples | | | Comparative examples | | |
|---|---|---|---|---|---|---|---|
| | | 29 | 30 | 31 | 1 | 2 | 3 |
| Base oil composition | | | | | | | |
| A-1 | mass % | 100 | 100 | 100 | 100 | 100 | 100 |
| A-2 | mass % | — | — | — | — | — | — |
| A-3 | mass % | — | — | — | — | — | — |
| A-4 | mass % | — | — | — | — | — | — |
| A-5 | mass % | — | — | — | — | — | — |
| Properties of the total base oil | | | | | | | |
| Kinematic viscosity (100° C.) | $mm^2/s$ | 2.7 | 2.7 | 2.7 | 2.7 | 2.7 | 2.7 |
| % $C_A$ | | 0 | 0 | 0 | 0 | 0 | 0 |
| (A) Total base oil | mass % | 94.3 | 96.6 | 97.7 | 95.3 | 94.3 | 94.3 |
| (B) Polymer | | | | | | | |
| B-1 | mass % | 1 | 1 | 1 | — | — | — |
| B-2 | mass % | — | — | — | — | — | — |
| B-3 | mass % | — | — | — | — | — | — |
| B*-4 | mass % | — | — | — | — | 1 | — |
| B*-5 | mass % | — | — | — | — | — | 1 |
| B-6 | mass % | — | — | — | — | — | — |
| B-7 | mass % | — | — | — | — | — | — |
| B-8 | mass % | — | — | — | — | — | — |
| B-9 | mass % | — | — | — | — | — | — |
| (C) Ca sulfonate | | | | | | | |
| C-1 | mass ppm/Ca | 100 | 100 | — | 100 | 100 | 100 |
| C-2 | mass ppm/Ca | — | — | — | — | — | — |
| (D)P-containing additive | | | | | | | |
| D-1 | mass ppm/P | 200 | 200 | 200 | 200 | 200 | 200 |
| D-2 | mass ppm/P | — | — | — | — | — | — |
| D-3 | mass ppm/P | — | — | — | — | — | — |
| (E)Ashless dispersant | | | | | | | |
| E-1 | mass % | 2 | 2 | 2 | 2 | 2 | 2 |
| E-2 | mass % | — | — | — | — | — | — |
| (F) Amine friction modifier | | | | | | | |
| F-1 | mass % | 0.005 | — | — | — | — | — |
| Other additives | mass % | 2.3 | — | — | 2.3 | 2.3 | 2.3 |
| Properties of the composition | | | | | | | |
| Kinematic viscosity (40° C.) | $mm^2/s$ | 12.2 | 12.1 | 12.1 | 11.7 | 12.9 | 12.6 |
| Kinematic viscosity (100° C.) | $mm^2/s$ | 3.3 | 3.3 | 3.3 | 3.2 | 3.4 | 3.4 |
| SAE No. 2 test | | | | | | | |
| Shift shock preventing index $\mu_0/\mu_d$ | | 1.09 | 1.13 | 1.15 | 1.24 | 1.21 | 1.18 |
| Unisteel test | | | | | | | |
| Fatigue life L50 of a bearing | h | 32.5 | 32.8 | 32.2 | 7.5 | 12.5 | 8.4 |
| Vane pump wear test | | | | | | | |
| Wear amount of a vane pump | mg | 1.0 | 1.2 | 1.2 | 8.1 | 6.6 | 6.3 |
| Kinematic viscosity reduction (100° C.) | % | 0.0 | 0.0 | 0.0 | 0.0 | 0.0 | 0.0 |
| Shear stability test (Sonic, 2 h) | | | | | | | |
| Kinematic viscosity reduction (100° C.) | % | 3.5 | 3.4 | 3.4 | 3.3 | 4.8 | 3.4 |

(SAE No. 2 Friction Test: Evaluation of Shift Shock Preventing Index)

A dynamic friction test was carried out on each of the lubricating oil compositions using SAE No. 2 Tester (manufactured by KOBELCO MACHINERY ENGINEERING Co., Ltd.) conforming to JASO M348: 2002. The coefficients of dynamic friction $\mu_d$ and $\mu_0$ between a friction plate (material: NW461E) and a steel plate after 2500 cycles were measured, to calculate the shift shock preventing index $\mu_0/\mu_d$.

The results are shown in tables 1 to 6. A lower shift shock preventing index $\mu_0/\mu_d$ calculated by $\mu_d$ and $\mu_0$ measured in this test means a better shift shock prevention properties.

(Unisteel Test: Evaluation of the Fatigue Life of a Bearing)

For each of the lubricating oil compositions, a rolling fatigue life of a thrust bearing was measured by a Unisteel test (IP305/79, The Institute of Petroleum) using a Unisteel rolling fatigue testing machine (triple-type high-temperature rolling fatigue testing machine TRF-1000/3-01H manufactured by TOKYO KOKI TESTING MACHINE CO. LTD.). The time until either a roller or a test piece suffered fatigue damage was measured for a test bearing made by replacing a bearing ring in one side of a thrust needle bearing (FNTA-2542C manufactured by NSK Ltd.) with the flat test piece (material: SUJ2), under the conditions of: 4000 N in load; 1.5 GPa in surface pressure; 1500 rpm in rotation number; and 120° C. in oil temperature. It was determined that fatigue damage occurred when the vibration acceleration of a testing portion measured by a vibration accelerometer installed in the Unisteel rolling fatigue testing machine reached 0.5 $m/s^2$. The test was repeated ten times, and then the fatigue life was calculated as the 50% life (L50: the time until the cumulative probability reaches 50%) by a Weibull plot based on the time it had taken for fatigue damage to occur in the tests. The results are shown in tables 1 to 6. A longer fatigue life L50 of a bearing measured in the tests means that the fatigue life of a bearing was able to be improved more.

(Vane Pump Wear Test)

Wear of a vane pump was evaluated for each of the lubricating oil compositions. A vane pump (Vickers™ vane pump V 104C manufactured by Eaton Corporation) was operated to pump a sample oil (30 L, 80° C. in oil temperature) in a tank so that the sample oil was circulated, under the conditions of 1200 rpm in rotation speed and 3.0 MPa in discharge pressure for 100 hours. The wear amount (mg) of the vane pump after the operation was measured. Further, the reduction (%) of the kinematic viscosity (100° C.) of the sample oil after the operation was measured. A lower wear amount of the vane pump measured in this test means that wear of the vane pump was able to be reduced more. No observation of the reduction of the kinematic viscosity of the sample oil after the operation means that shear applied to the lubricating oil in the vane pump did not involve wear of the vane pump.

(Shear Stability Test)

Shear stability of each of the lubricating oil compositions was evaluated by a shear stability test conforming to JPI-5S-29-88. A sample oil was irradiated with ultrasonic waves having a frequency of 10 kHz from an oscillator of an 28 μm in amplitude for 2 hours, and the reduction (%) of the kinematic viscosity of the sample oil at 100° C. after the irradiation of ultrasonic waves to that before the irradiation was calculated. The results are shown in tables 1 to 6. A lower reduction of the kinematic viscosity means higher shear stability and better durability. In this test, the reduction of the kinematic viscosity (100° C.) is preferably no more than 4.5%.

(Evaluation Results)

The lubricating oil compositions of examples 1 to 31 showed good results in both the shift shock preventing index and the fatigue life L50 of a bearing.

The composition of comparative example 1, which did not comprise the component (B) (poly(meth)acrylate), showed results inferior in the shift shock preventing index, the fatigue life L50 of a bearing, and wear of a vane pump.

The composition of comparative example 2, which comprised the component (B) (poly(meth)acrylate) having a weight average molecular weight of more than 25,000, showed results inferior in the shift shock preventing index, the fatigue life L50 of a bearing, and wear of a vane pump.

The composition of comparative example 3, which comprised ethylene-propylene copolymer (weight average molecular weight: 13,000) as the component (B) instead of poly(meth)acrylate, showed results inferior in the shift shock preventing index, the fatigue life L50 of a bearing, and wear of a vane pump.

We claim:

1. A lubricating oil composition for a transmission, the composition comprising:

(A) a lubricant base oil comprising a mineral base oil and/or a synthetic base oil; and (B) at least one polyalkyl (meth)acrylate (B2) each having a weight average molecular weight of no more than 15,000, wherein each of the polyalkyl (meth)acrylate (B2) has a monomer composition consisting of:

at least one alkyl (meth)acrylate monomer unit (B2a) in an amount of no less than 75 mol % on the basis of the total monomer units of the polylalkyl (meth)acrylate (B2), wherein the monomer unit (B2a) is represented by the general formula (1) wherein $R^1$ is a hydrogen atom or a methyl group, and $R^2$ is a C8-18 linear or branched chain alkyl group;

optionally at least one alkyl (meth)acrylate monomer unit (B2d) represented by the general formula (1) wherein $R^1$ is a hydrogen atom or a methyl group, and $R^2$ is a C1-3 linear or branched chain alkyl group;

optionally at least one alkyl (meth)acrylate monomer unit (B2e) represented by the general formula (1) wherein $R^1$ is a hydrogen atom or a methyl group, and $R^2$ is a C4-7 linear or branched chain alkyl group;

optionally at least one alkyl (meth)acrylate monomer unit (B2g) represented by the general formula (1) wherein $R^1$ is a hydrogen atom or a methyl group, and $R^2$ is a C19-36 linear or branched chain alkyl group;

optionally at least one alkyl (meth)acrylate monomer unit (B2f) represented by the general formula (1) wherein $R^1$ is a hydrogen atom or a methyl group, and $R^2$ is a linear or branched chain alkyl group having at least 37 carbons; and optionally at least one monomer unit (B2h) other than any (meth)acrylate monomer unit, (1)

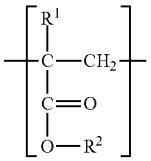

wherein the composition has a kinematic viscosity at 100° C. of 2.5 to 4.9 $mm^2/s$.

2. The lubricating oil composition according to claim 1, wherein the component (A) has a kinematic viscosity at 100° C. of 2.0 to 3.8 $mm^2/s$.

3. The lubricating oil composition according to claim 1, wherein the component (A) has a % $C_A$ of no more than 1.0.

4. The lubricating oil composition according to claim 1, wherein the component (B) is a non-dispersant poly (meth)acrylate.

5. The lubricating oil composition according to claim 1, wherein a content of the component (B) is 0.01 to 5 mass % on the basis of the total mass of the composition.

6. The lubricating oil composition according to claim 1, wherein the component (B) is a poly(meth)acrylate comprising a branched chain alkyl group in a side chain.

7. The lubricating oil composition according to claim 1, further comprising:

(C) a calcium sulfonate detergent.

8. The lubricating oil composition according to claim 7, wherein the component (C) is a calcium sulfonate detergent comprising an alkyl group derived from an oligomer of an olefin, the olefin having at least 3 carbons.

9. The lubricating oil composition according to claim 1, wherein a content of the component (B2) is no less than 0.2 mass % on the basis of the total mass of the composition;

and each of the polyalkyl (meth)acrylate (B2) optionally further comprises (B2c) a methyl (meth)acrylate monomer unit in an amount of less than 3 mol % on the basis of the total monomer units of the polyalkyl (meth)acrylate (B2).

10. The lubricating oil composition according to claim 9, wherein each of the polyalkyl (meth)acrylate (B2) optionally comprises the at least one alkyl (meth)acrylate monomer unit (B2d) in an amount of less than 3 mol % on the basis of the total monomer units of the polyalkyl (meth)acrylate (B2).

11. The lubricating oil composition according to claim 9, wherein each of the polyalkyl (meth)acrylate (B2) optionally comprises the at least one alkyl (meth)acrylate monomer unit (B2e) in an amount of no more than 20 mol % on the basis of the total monomer units of the polyalkyl (meth)acrylate (B2).

12. The lubricating oil composition according to claim 9, wherein each of the polyalkyl (meth)acrylate (B2) optionally comprises the at least one alkyl (meth)acrylate monomer unit (B2f) in an amount of less than 3 mol % on the basis of the total monomer units of the polyalkyl (meth)acrylate (B2).

13. The lubricating oil composition according to claim 9, wherein each of the polyalkyl (meth)acrylate (B2) optionally comprises the at least one alkyl (meth)acrylate monomer unit (B2g) in an amount of no more than 10 mol % on the basis of the total monomer units of the polyalkyl (meth)acrylate (B2).

14. The lubricating oil composition according to claim 9, wherein each of the polyalkyl (meth)acrylate (B2) optionally comprises the at least one monomer unit (B2h) in an amount of less than 10 mol % on the basis of the total monomer units of the polyalkyl (meth)acrylate (B2), wherein the monomer unit (B2h) is at least one monomer unit corresponding to at least one comonomer selected from a group consisting of a C2-18 α-olefin, an α,β-unsaturated dicarboxylic acid diester, and any combination thereof.

15. The lubricating oil composition according to claim 1, further comprising:

(D) a phosphorus-containing additive in an amount of 50 to 800 mass ppm in terms of phosphorus on the basis of the total mass of the composition; and (E) a succinimide ashless dispersant in an amount of 0.2 to 8 mass % on the basis of the total mass of the composition.

16. The lubricating oil composition according to claim 1, optionally further comprising:

(F) an amine friction modifier in an amount of no more than 50 mass ppm on the basis of the total mass of the composition.

17. A lubricating oil composition for a transmission, the composition comprising:

(A) a lubricant base oil comprising a mineral base oil and/or a synthetic base oil, and having a kinematic viscosity at 100° C. of 2.0 to 2.2 $mm^2/s$; and (B) at least one polyalkyl (meth)acrylate (B2) each having a weight average molecular weight of no more than 15,000, each of the polyalkyl (meth)acrylate (B2) comprising at least one alkyl (meth)acrylate monomer unit (B2a) in an amount of no less than 75 mol % on the basis of the total monomer units of the polylalkyl (meth)acrylate (B2), wherein the monomer unit (B2a) is represented by the general formula (1) wherein $R^1$ is a hydrogen atom or a methyl group, and $R^2$ is a C8-18 linear or branched chain alkyl group,

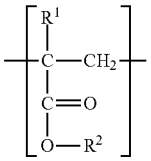

(1)

wherein the composition has a kinematic viscosity at 100° C. of 2.5 to 4.9 $mm^2/s$.

* * * * *